US009950858B2

(12) United States Patent
Byrd, Jr. et al.

(10) Patent No.: US 9,950,858 B2
(45) Date of Patent: Apr. 24, 2018

(54) TOBACCO-DERIVED CELLULOSE MATERIAL AND PRODUCTS FORMED THEREOF

(71) Applicants: R.J. REYNOLDS TOBACCO COMPANY, Winston-Salem, NC (US); NORTH CAROLINA STATE UNIVERSITY, Raleigh, NC (US)

(72) Inventors: Medwick Vaughan Byrd, Jr., Raleigh, NC (US); David Neil McClanahan, Winston-Salem, NC (US); Samuel Mark Debusk, Lexington, NC (US)

(73) Assignees: R.J. Reynolds Tobacco Company, Winston-Salem, NC (US); North Carolina State University, Raleigh, NC (US)

( * ) Notice: Subject to any disclaimer, the term of this patent is extended or adjusted under 35 U.S.C. 154(b) by 241 days.

(21) Appl. No.: 14/599,258

(22) Filed: Jan. 16, 2015

(65) Prior Publication Data

US 2016/0208440 A1 Jul. 21, 2016

(51) Int. Cl.
*D21H 11/12* (2006.01)
*D21H 27/10* (2006.01)
(Continued)

(52) U.S. Cl.
CPC ..... *B65D 85/1018* (2013.01); *A24C 1/26* (2013.01); *A24C 5/005* (2013.01); *A24D 1/02* (2013.01);
(Continued)

(58) Field of Classification Search
CPC ..... D21H 5/16; D21H 11/12; D21H 27/005; D21H 27/007; D21H 27/08; D21H 27/10;
(Continued)

(56) References Cited

U.S. PATENT DOCUMENTS 246,117 A * 8/1881 Funke ..... A24B 15/12 131/353
787,611 A 4/1905 Daniels, Jr.
(Continued)

FOREIGN PATENT DOCUMENTS

CN 1324586 12/2001
CN 102669809 9/2012
(Continued)

OTHER PUBLICATIONS

Agrupis, S., et al., "Industrial utilization of tobacco stalks I—Preliminary evaluation of biomass resource," *Holzforschung,* 1999, pp. 29-32, vol. 53(1).
(Continued)

*Primary Examiner* — Eric Hug
(74) *Attorney, Agent, or Firm* — Womble Bond Dickinson (US) LLP

(57) ABSTRACT

A paper material is provided herein, wherein the paper material includes a fibrous material including at least 5 dry weight percent of fibers derived from a plant of the *Nicotiana* species; wherein the paper material has a basis weight ranging from about 5 g/m$^2$ to about 450 g/m$^2$; and wherein the paper material has a caliper ranging from about 0.01 mils to about 200 mils. The paper material can be suitable for use in a smoking article in the form of at least one of a tipping material, a plug wrap and a wrapping material. The paper material can be suitable for use in at least one of a soft carton container suitable to house smoking articles, a label, a paper substrate of a barrier layer, a hard carton suitable to house smoking articles and a container suitable to house smokeless tobacco products.

43 Claims, 9 Drawing Sheets

(51) Int. Cl.

| | |
|---|---|
| ***B65D 85/10*** | (2006.01) |
| ***A24D 1/02*** | (2006.01) |
| ***A24D 3/00*** | (2006.01) |
| ***A24C 5/00*** | (2006.01) |
| ***A24C 1/26*** | (2006.01) |
| ***D21H 17/64*** | (2006.01) |
| ***D21H 27/00*** | (2006.01) |

(52) U.S. Cl.
CPC ..... *A24D 3/00* (2013.01); *B65D 85/1045* (2013.01); *D21H 5/16* (2013.01); *D21H 11/12* (2013.01); *D21H 17/64* (2013.01); *D21H 27/10* (2013.01)

(58) Field of Classification Search
CPC . A24D 1/02; A24D 1/022; A24D 3/00; A24D 3/02; A24C 5/00; A24C 5/005; B65D 85/10; B65D 85/1018; A24B 3/14
USPC ..... 162/139; 131/365, 358, 275, 105, 374
See application file for complete search history.

(56) References Cited

U.S. PATENT DOCUMENTS 1,086,306 A 2/1914 Oelenheinz
1,437,095 A 11/1922 Delling
1,496,474 A 6/1924 Lloyd
1,757,477 A 5/1930 Rosenhoch
2,122,421 A 7/1938 Hawkinson
2,148,147 A 2/1939 Baier
2,170,107 A 8/1939 Baier
2,274,649 A 3/1942 Baier
2,766,148 A 10/1956 Rowland
2,770,239 A 11/1956 Prats et al.
2,795,545 A 6/1957 Gluesenkamp
2,960,264 A 11/1960 Walter
3,224,927 A 12/1965 Brown et al.
3,253,978 A 5/1966 Bodendorf et al.
3,398,754 A 8/1968 Tughan
3,612,065 A 10/1971 Rosen
3,647,684 A 3/1972 Malcolm
3,661,192 A 5/1972 Nicholson et al.
3,691,010 A 9/1972 Krake
3,776,897 A 12/1973 Ikari et al.
3,847,164 A 11/1974 Mattina et al.
3,861,602 A 1/1975 Smith
4,098,421 A 7/1978 Foster
4,102,737 A 7/1978 Morton
4,131,117 A 12/1978 Kite et al.
4,135,563 A 1/1979 Maucher
4,182,349 A 1/1980 Selke
4,190,170 A 2/1980 Boyd
4,194,514 A 3/1980 Campbell
4,210,490 A 7/1980 Taylor
4,244,381 A 1/1981 Lendvay
4,270,552 A 6/1981 Jenkins et al.
4,298,013 A 11/1981 Semp et al.
4,308,877 A 1/1982 Mattina
4,341,228 A 7/1982 Keritsis et al.
4,366,824 A 1/1983 Rainer et al.
4,385,961 A 5/1983 Svending et al.
4,388,150 A 6/1983 Sunden et al.
4,388,933 A 6/1983 Rainer et al.
4,421,126 A 12/1983 Gellatly
4,511,433 A 4/1985 Tournier et al.
4,643,801 A 2/1987 Johnson
4,706,692 A 11/1987 Gellatly
4,742,955 A 5/1988 Focke et al.
4,749,444 A 6/1988 Lorz et al.
4,753,384 A 6/1988 Focke et al.
4,753,710 A 6/1988 Langley et al.
4,852,734 A 8/1989 Allen et al.
4,895,175 A 1/1990 Baskevitch et al.
4,941,484 A 7/1990 Clapp et al.
4,962,774 A 10/1990 Thomasson et al.
4,987,906 A 1/1991 Young et al.
5,005,620 A 4/1991 Morey
5,044,550 A 9/1991 Lamm
5,049,236 A 9/1991 Dimmel et al.
5,056,537 A 10/1991 Brown et al.
5,071,512 A 12/1991 Bixler et al.
5,091,054 A 2/1992 Meier et al.
5,097,948 A 3/1992 Campbell
5,143,097 A 9/1992 Sohn et al.
5,159,942 A 11/1992 Brinkley et al.
5,161,733 A 11/1992 Latif
5,193,674 A 5/1993 Cobler et al.
5,220,930 A 6/1993 Gentry
5,246,543 A 9/1993 Meier et al.
5,325,877 A 7/1994 Young et al.
5,333,729 A 8/1994 Wolfe
5,379,889 A 1/1995 Cobler
5,445,169 A 8/1995 Brinkley et al.
5,501,237 A 3/1996 Young et al.
5,533,530 A 7/1996 Young et al.
5,556,365 A 9/1996 Drummond et al.
5,582,681 A 12/1996 Back et al.
5,586,963 A 12/1996 Lennon et al.
5,617,881 A 4/1997 Kossmehl et al.
5,682,986 A 11/1997 Cobler
5,699,903 A 12/1997 Focke et al.
5,715,844 A 2/1998 Young et al.
5,724,998 A 3/1998 Gellatly et al.
5,788,066 A 8/1998 Focke et al.
5,806,671 A 9/1998 Focke et al.
5,829,669 A 11/1998 Drummond et al.
5,981,837 A 11/1999 Chapple
6,007,678 A 12/1999 Linsten et al.
6,019,870 A 2/2000 Devic et al.
6,036,629 A 3/2000 Rea et al.
6,164,443 A * 12/2000 Mitchell ..... A24C 5/40 131/347
6,164,444 A 12/2000 Bray et al.
6,165,318 A 12/2000 Paren et al.
6,214,164 B1 4/2001 Rantala
6,216,706 B1 4/2001 Kumar et al.
6,248,210 B1 6/2001 Edwards et al.
6,360,943 B1 3/2002 Focke et al.
6,398,908 B1 6/2002 Hermansson et al.
6,489,538 B1 12/2002 Chapple
6,503,369 B2 1/2003 Rousu et al.
6,558,306 B2 5/2003 Lowry et al.
6,610,908 B1 8/2003 Chapple
6,772,767 B2 8/2004 Mua et al.
6,773,552 B1 8/2004 Albert et al.
6,824,645 B2 11/2004 Jaschinski et al.
6,923,887 B2 8/2005 Pan
6,929,013 B2 8/2005 Ashcraft et al.
6,976,493 B2 * 12/2005 Chapman ..... A24D 1/025 131/349
7,014,039 B2 3/2006 Henson et al.
7,237,559 B2 7/2007 Ashcraft et al.
7,291,249 B2 11/2007 Thoröe-Scherb et al.
7,484,619 B2 2/2009 Boriani et al.
D592,956 S 5/2009 Thiellier
D594,154 S 6/2009 Patel et al.
7,584,843 B2 9/2009 Kutsch et al.
7,600,518 B2 10/2009 Ogleseby et al.
7,617,930 B2 11/2009 Jones et al.
7,789,089 B2 9/2010 Dube et al.
7,798,319 B1 9/2010 Bried et al.
D625,178 S 10/2010 Bailey et al.
7,878,324 B2 2/2011 Bellamah et al.
7,910,209 B2 3/2011 Uchida et al.
7,943,350 B2 5/2011 Vlasenko et al.
7,946,450 B2 5/2011 Gelardi et al.
8,016,105 B2 9/2011 Sendo
8,033,425 B2 10/2011 Gelardi
8,087,540 B2 1/2012 Bailey et al.
8,096,411 B2 1/2012 Bailey et al.
8,360,072 B2 1/2013 Krauss
8,377,262 B2 2/2013 Quigley
8,414,741 B2 4/2013 Klerelid et al.
8,893,725 B2 11/2014 Dube et al.

(56) References Cited

U.S. PATENT DOCUMENTS

| | | | | |
|---|---|---|---|---|
| 9,107,453 | B2 | 8/2015 | Dube et al. | |
| 2002/0197688 | A1 | 12/2002 | Pandolfino | |
| 2004/0214702 | A1* | 10/2004 | Stroud, Jr. | D21B 1/12 493/39 |
| 2004/0231060 | A1 | 11/2004 | Burdette et al. | |
| 2007/0193596 | A1 | 8/2007 | Mori et al. | |
| 2007/0215167 | A1 | 9/2007 | Crooks et al. | |
| 2008/0196847 | A1 | 8/2008 | van Heiningen et al. | |
| 2009/0014343 | A1 | 1/2009 | Clark et al. | |
| 2009/0014450 | A1 | 1/2009 | Bjorkholm | |
| 2009/0090478 | A1 | 4/2009 | Hollomon et al. | |
| 2009/0118477 | A1 | 5/2009 | Hallberg et al. | |
| 2009/0145021 | A1 | 6/2009 | Guay et al. | |
| 2009/0230003 | A1 | 9/2009 | Thiellier | |
| 2009/0246525 | A1 | 10/2009 | Uchida et al. | |
| 2010/0017916 | A1 | 1/2010 | Pappan et al. | |
| 2010/0036113 | A1 | 2/2010 | Mambrim Filho et al. | |
| 2010/0084424 | A1 | 4/2010 | Gelardi | |
| 2010/0108081 | A1 | 5/2010 | Blevins et al. | |
| 2010/0108084 | A1 | 5/2010 | Norman et al. | |
| 2010/0133140 | A1 | 6/2010 | Bailey et al. | |
| 2010/0249390 | A1 | 9/2010 | Azuma et al. | |
| 2010/0279361 | A1 | 11/2010 | South et al. | |
| 2010/0294289 | A1 | 11/2010 | Dube et al. | |
| 2011/0204074 | A1 | 8/2011 | Gelardi et al. | |
| 2012/0040408 | A1 | 2/2012 | Decker et al. | |
| 2012/0125354 | A1 | 5/2012 | Byrd et al. | |
| 2012/0152265 | A1 | 6/2012 | Dube et al. | |
| 2012/0211016 | A1 | 8/2012 | Byrd, Jr. et al. | |
| 2013/0014771 | A1 | 1/2013 | Coleman, III et al. | |
| 2013/0167849 | A1 | 7/2013 | Ademe et al. | |
| 2013/0276801 | A1 | 10/2013 | Byrd, Jr. et al. | |
| 2013/0286452 | A1 | 10/2013 | Hugonnet | |
| 2014/0227161 | A1 | 8/2014 | Manesh et al. | |
| 2014/0256829 | A1 | 9/2014 | Junker | |
| 2014/0326422 | A1 | 11/2014 | Fallon et al. | |
| 2015/0001148 | A1* | 1/2015 | Pan | D21H 27/08 210/508 |
| 2015/0107790 | A1 | 4/2015 | Sixta et al. | |
| 2015/0114412 | A1* | 4/2015 | Dittrich | A24D 1/02 131/332 |
| 2015/0201669 | A1 | 7/2015 | Junker et al. | |

FOREIGN PATENT DOCUMENTS

| | | |
|---|---|---|
| CN | 103110186 | 5/2013 |
| CN | 103445295 | 12/2013 |
| CN | 103829374 | 6/2014 |
| JP | 1162008 | 10/1997 |
| WO | WO 2013/160671 | 10/2013 |

OTHER PUBLICATIONS

Alonso et al., "Integrated Conversion of Hemicellulose and Cellulose from Lignocellulosic Biomass," *Energy & Environmental Science,* 2013, vol. 6, pp. 76-80.

Bose, S.K, et al., "Lignin content versus syringyl to guaiacyl ratio amongst poplars," Bioresource Technology, 2009, pp. 1628-1633, vol. 100(4).

Chen, et al., "Alkali-oxygen pulping of rice straw—Two-stage pulping by alkali soaking and oxygen cooking," *Tappi Journal,* 1994, pp. 109-113, vol. 77(7).

Gao, et al., "Effects of beating on tobacco stalk mechanical pulp," *Cellulose chemistry and technology,* 2012, pp. 277-282, vol. 46(3-4).

Kajita, et al., "Improvement in pulping and bleaching properties of xylem from transgenic tobacco plants," *Journal of the Science of Food and Agriculture,* 2002, pp. 1216-1223, vol. 82(10).

Kimura, et al., "Studies on the manufacture of tobacco stem pulp II—Pulping of tobacco stem with alkalies (Japanese language)," *Japan Tappi Journal,* 1962, pp. 978-984, vol. 16(12).

Mohta, D., et al., "Production of Refiner Mechnical Pulp From Kenaf for Newsprint in Developing Countries," TAPPI Journal, 2004, vol. 3(4).

Ralph et al., "NMR Characterization of Altered Lignins Extracted from Tobacco Plants Down-Regulated for Lignification Enzymes Cinnamyl-Alcohol Dehydrogenase and Cinnamoyl-CoA Reductase" *Proceedings of the National Academy of Sciences,* 1998, vol. 95, pp. 12803-12808. http://www.ncbi.nlm.nih.gov/pmc/articles/PMC23601/.

Sabharwal, H.S., et al., "Refiner Mechanical and Biomechanical Pulping of Jute," Holzforschung, 1995, pp. 537-544, vol. 49.

Wu, G., et al., "Improved Alkaline Oxidation Process for the Production of Aldehydes (Vanillin and Syringaldehyde) from Steam-Explosion Hardwood Lignin," Industrial & Engineering Chemistry Research, 1994, pp. 718-723, vol. 33.

Zhang, Yi-Heng Percival et al., Toward and Aggregated Understanding of Enzymatic Hydrolysis of Cellulose: Noncomplexed Cellulase Systems. Wiley InterScience. Biotechnology and Bioengineering, vol. 88, No. 7, Dec. 30, 2004, p. 797-824.

Ziaie-Shirkolaee et al. "Study on Cellulose Degradation During Organosolv Delignification of Wheat Straw and Evaluation of Pulp Properties," *Iranian Polymer Journal,* 2007, pp. 83-96, vol. 16, (2).

* cited by examiner

300

305

TOBACCO-DERIVED CELLULOSE MATERIAL AND PRODUCTS FORMED THEREOF

FIELD OF THE DISCLOSURE

The present disclosure relates to products made or derived from tobacco, or that otherwise incorporate tobacco, and methods for the production thereof. The tobacco-derived products can be employed in paper products, containers for packaging a variety of consumer goods and related packaging materials.

BACKGROUND OF THE DISCLOSURE

Paper is a cellulose pulp derived material that can be used in a number of different products and applications. For each papermaking process, a correlation exists between the fibers used and the characteristics of the final paper product. See, e.g., U.S. Pat. No. 5,582,681 to Back et al.; Sabharwal, H. S., Akhtar, M., Blanchette, R. A., and Young, R. A., *Refiner Mechanical and Biomechanical Pulping of Jute*, Holzforschung 49: 537-544, 1995; and Mohta, D., Roy, D. N., and Whiting, P., *Production of Refiner Mechanical Pulp From Kenaf for Newsprint in Developing Countries*, TAPPI Journal Vol. 3(4), 2004; each of which is herein incorporated by reference in its entirety. The quality of the final paper product and the type of paper product produced is also dependent on pulping, refining and other general papermaking processes used.

Various methods for producing a reconstituted tobacco involve the use of paper-making techniques. In a typical paper-making reconstituted tobacco process, tobacco is extracted with water, and the resulting aqueous extract and water insoluble pulp are separated from one another. The pulp portion can be refined to a desired consistency, and formed into a mat or web, much like wood pulp fibers in a traditional paper making process. The aqueous tobacco extract is applied to the mat of insoluble pulp, and the overall resulting mixture is dried to provide a reconstituted tobacco sheet incorporating the tobacco components from which that sheet can be derived. Typically, tobacco stems are used in making such a reconstituted tobacco sheet, because the fibrous nature of those stems provides strength and structural integrity to the resulting sheet. See, for example, U.S. Pat. No. 3,398,754 to Tughan; U.S. Pat. No. 3,847,164 to Mattina; U.S. Pat. No. 4,131,117 to Kite; U.S. Pat. No. 4,182,349 to Selke; U.S. Pat. No. 4,270,552 to Jenkins; U.S. Pat. No. 4,308,877 to Mattina; U.S. Pat. No. 4,341,228 to Keritsis; U.S. Pat. No. 4,421,126 to Gellatly; U.S. Pat. No. 4,706,692 to Gellatly; U.S. Pat. No. 4,962,774 to Thomasson; U.S. Pat. No. 4,941,484 to Clapp; U.S. Pat. No. 4,987,906 to Young; U.S. Pat. No. 5,056,537 to Brown; U.S. Pat. No. 5,143,097 to Sohn; U.S. Pat. No. 5,159,942 to Brinkley et al.; U.S. Pat. No. 5,325,877 to Young; U.S. Pat. No. 5,445,169 to Brinkley; U.S. Pat. No. 5,501,237 to Young; and U.S. Pat. No. 5,533,530 to Young, which are incorporated herein by reference.

Cigarettes, cigars, and pipes are popular smoking articles that employ tobacco in various forms. Such smoking articles are employed by heating or burning tobacco to generate aerosol (e.g., smoke) that can be inhaled by the smoker. Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments. Typically, the filter element is attached to one end of the tobacco rod using a circumscribing wrapping material known as "tipping paper." Descriptions of cigarettes and the various components thereof are set forth in *Tobacco Production, Chemistry and Technology*, Davis et al. (Eds.) 1999. Various properties of paper materials used for cigarette manufacture, and of the cigarettes manufactured using those papers, are set forth in Durocher, *TJI*, 188-194 (March/1985), herein incorporated by reference in its entirety.

Various types of containers for dispensing solid objects, particularly solid products intended for human consumption, are known in the art. Such containers are often characterized by a hand-held size that can be easily stored and transported. Exemplary consumable products that are often packaged in such containers include a wide variety of consumer products, including tobacco-related products. Cigarette packages and containers that protect the cigarettes from crushing and/or preserve the freshness of the cigarettes are known in the prior art. See, e.g., U.S. Pat. No. 5,699,903 to Focke et al.; U.S. Pat. No. 5,161,733 to Latif; U.S. Pat. No. 7,484,619 to Boriani et al; U.S. Pat. No. 7,617,930 to Jones et al.; and U.S. Pat. No. 8,016,105 to Sendo, each of which is incorporated herein by reference. Typically, such prior art packages are box-shaped containers made of a paper or cardstock material in either a "softpack" or "hardpack" form. While some designs of the softpack package are capable of retaining a measure of freshness, the softpack package offers little, or no protection against crushing. Similarly, some designs of the hardpack package help to preserve freshness to some extent and offer some protection against crushing. An example of a hardpack package is shown in U.S. Pat. No. 6,164,444 to Bray et al., herein incorporated by reference in its entirety, which discloses a typical hinged-lid, box-shaped container that is made from a "rigid card material." Further examples of cigarette or tobacco packages made of a paper or cardstock material are disclosed in U.S. Pat. No. 1,496,474 to Lloyd; U.S. Pat. No. 2,960,264 to Walter; U.S. Pat. No. 5,044,550 to Lamm; and U.S. Pat. No. 5,097,948 to Campbell, each of which is herein incorporated by reference in its entirety.

Smokeless tobacco products are typically sold in hand-held tins or pucks constructed of fiberboard, metal, or molded plastic (e.g., polypropylene), and which have an outer paper or plastic seal enclosing the container. Such containers generally have a shallow cylindrical shape with a detachable lid. See, for example, the containers set forth in U.S. Pat. No. 4,098,421 to Foster; U.S. Pat. No. 4,190,170 to Boyd; and U.S. Pat. No. 7,798,319 to Bried et al., each of which is incorporated herein by reference.

As exemplified above, there are countless uses for paper and paperboard products. It would desirable to provide further uses for tobacco in paper products.

BRIEF SUMMARY OF THE DISCLOSURE

The present invention provides tobacco-derived paper products, packaging materials, and containers for tobacco products and other consumer and food items. In particular, a fibrous material comprising at least 10 dry weight percent of fibers derived from a plant of the *Nicotiana* species is disclosed, as well as a method of manufacturing such a fibrous material. Exemplary uses for a tobacco-derived fibrous material are also described herein.

In some embodiments, a paper material is provided comprising a fibrous material comprising at least 5 dry weight percent of fibers derived from a plant of the *Nicotiana* species. The paper material can have a basis weight ranging from about 5 $g/m^2$ to about 450 $g/m^2$ and a caliper ranging from about 0.01 mils to about 200 mils (or about 0.0001 inches to about 0.2 inches). In certain embodiments, the fibrous material can comprise at least 5 dry weight percent of fibers derived from a plant of the *Nicotiana* species.

In various embodiments, the paper material can be characterized by certain parameters. For example, the paper material can have a tearing index ranging from about 4.0 $mN*m^2/g$ to about 6.5 $mN*m^2/g$. The paper material can have a tensile index ranging from about 35 Nm/g to about 70 Nm/g and a Tensile Energy Adsorption ranging from about 0.1 J/g to about 1.0 J/g. In some embodiments, the paper material can have a bursting index ranging from about 3.0 $kPa*m^2/g$ to about 5.0 $kPa*m^2/g$. The paper material can have a Scott internal bond ranging from about 1.0 to about 6.0. In certain embodiments, the paper material can have a bending resistance ranging from about 0.1 Tabor Stiffness units to about 2.0 Tabor Stiffness units, or from about 55 Tabor Stiffness units to about 90 Tabor Stiffness units. In various embodiments, the paper material can have a folding endurance ranging from about 3000 to about 20,000 MIT double folds at 0.5 kg loading, or from about 2000 to about 5000 MIT double folds at 1.0 kg loading. The paper material can have a Parker roughness value ranging from about 5.0 to about 8.0. The paper material can have a Cobb value ranging from about 50 $g/m^2$ to about 200 $g/m^2$.

In some embodiments, the paper material can be suitable for use in a smoking article in the form of at least one of a tipping material, a plug wrap and a wrapping material. Further, the paper material can have a basis weight that ranges from about 10 $g/m^2$ to about 150 $g/m^2$, or from about 12 $g/m^2$ to about 120 $g/m^2$, and a caliper that ranges from about 0.01 mils to about 8 mils, or about 1.0 mils to about 6.0 mils. The paper material can comprise about 50-90 dry weight percent of fibrous material. The fibrous material can comprise about 5-100 dry weight percent of fibers derived from a plant of the *Nicotiana* species. For example, the paper material can comprise about 55-70 dry weight percent of the fibrous material, wherein the fibrous material can comprise about 5-100 (e.g., about 40-60) dry weight percent of fibers derived from a plant of the *Nicotiana* species. The paper material can be useful as a tipping material, for example. In certain embodiments, the paper material can comprise about 55-90 dry weight percent of the fibrous material, wherein the fibrous material can comprise about 5-100 (e.g., about 40-60) dry weight percent of fibers derived from a plant of the *Nicotiana* species. The paper material can be useful as a plug wrap material, for example. In certain embodiments, the paper material can comprise about 55-70 dry weight percent of the fibrous material, wherein the fibrous material can comprise about 5-100 (e.g., about 5-20) dry weight percent of fibers derived from a plant of the *Nicotiana* species. The paper material can be useful as a wrapping material or a paper useful for rolling one's own cigarette (RYO paper), for example.

In some embodiments, the paper material can be suitable for use in at least one of a soft carton container suitable to house smoking articles, a label, and a paper substrate of a barrier layer. Further, the paper material can have a basis weight that ranges from about 10 $g/m^2$ to about 150 $g/m^2$, about 10 $g/m^2$ to about 75 $g/m^2$, or about 50 $g/m^2$ to about 150 $g/m^2$. The paper material can have a caliper ranging from about 1.0 mils to about 200 mils, about 1.0 mils to about 100 mils, or about 1.0 mils to about 6.0 mils, for example. The paper material can comprise about 80-95 dry weight percent of the fibrous material, wherein the fibrous material can comprise about 5-100 (e.g., about 75-100) dry weight percent of fibers derived from a plant of the *Nicotiana* species.

In various embodiments, the paper material can be suitable for use in at least one of a hard carton suitable to house smoking articles and a container suitable to house smokeless tobacco products. Further, the paper material can have a basis weight that ranges from about 50 $g/m^2$ to about 275 $g/m^2$, or from about 175 $g/m^2$ to about 275 $g/m^2$, and a caliper ranges from about 3 mils to about 200 mils, or about 0.003 inches to about 0.200 inches. The paper material can comprise about 80-95, or about 80-90 dry weight percent of the fibrous material, wherein the fibrous material can comprise about 5-100 (e.g., about 75-90) dry weight percent of fibers derived from a plant of the *Nicotiana* species.

A smoking article is provided herein, wherein the smoking article can comprise a tobacco rod comprising a lighting end and a mouth end, wherein the tobacco rod can comprise a circumscribing wrapping material; a filter element, wherein the filter element can be positioned adjacent to the mouth end of the tobacco rod such that the filter element and the tobacco rod are axially aligned in an end-to-end relationship; wherein the filter element can be circumscribed along its outer circumference or longitudinal periphery by a layer of outer plug wrap; wherein the filter element can be attached to the tobacco rod using tipping material that circumscribes both the entire length of the filter element and an adjacent region of the tobacco rod; and wherein at least one of the wrapping material, the outer plug wrap, and the tipping material can comprise a paper material comprising a fibrous material comprising at least 5 dry weight percent fibers derived from a plant of the *Nicotiana* species; wherein the paper material can have a basis weight ranging from about 10 $g/m^2$ to about 150 $g/m^2$; and wherein the paper material can have a caliper ranging from about 0.01 mils to about 8 mils, or about 1.0 mils to about 6.0 mils.

In certain embodiments, the tipping material of a smoking article can comprise the paper material described herein, wherein the paper material can comprise about 55-70 dry weight percent of the fibrous material, and wherein the fibrous material can comprise about 5-100 dry weight percent (e.g., 40-60 dry weight percent) of fibers derived from a plant of the *Nicotiana* species. In some embodiments, the plug wrap can comprise the paper material described herein, wherein the paper material can comprise about 55-90 dry weight percent of the fibrous material, and wherein the fibrous material can comprise about 5-100 (e.g., 40-60) dry weight percent of fibers derived from a plant of the *Nicotiana* species. In some embodiments the wrapping material can comprise the paper material described herein, wherein the paper material can comprise about 55-70 dry weight percent of the fibrous material, and wherein the fibrous material can comprise about 5-100 (e.g., 5-20) dry weight percent of fibers derived from a plant of the *Nicotiana* species.

In various embodiments, a container formed from the paper material described herein can be provided. In certain embodiments, the container can be a smokeless tobacco container or a cigarette pack. The container can comprise a body having a bottom wall and a side wall, the bottom wall and the side wall defining an internal storage compartment adapted for storage of a product and a top configured to be engaged with the body. At least one of the bottom wall, side wall, and top can comprise a paper material, wherein the paper material can comprise a fibrous material that can comprise at least about 5 or at least about 60 dry weight percent fibers derived from a plant of the *Nicotiana* species. Further, the paper material can have a basis weight ranging from about 10 g/m$^2$ to about 350 g/m$^2$, or about 10 g/m$^2$ to about 275 g/m$^2$ (e.g., about 10 g/m$^2$ to about 75 g/m$^2$ or about 50 g/m$^2$ to about 275 g/m$^2$), and a caliper ranging from about 1 mils to about 200 mils, or about 0.001 inches to about 0.200 inches.

In some embodiments, the basis weight of the paper material forming a container can range from about 10 g/m$^2$ to about 150 g/m$^2$ or about 10 g/m$^2$ to about 75 g/m$^2$, and the caliper can range from about 1.0 mils to about 200 mils, 1.0 mils to about 100 mils, or about 1.0 mils to about 6 mils. Further, the paper material can comprise about 80-95 or about 85-90 dry weight percent of the fibrous material, wherein the fibrous material can comprise about 5-100 (e.g., about 75-100) dry weight percent of fibers derived from a plant of the *Nicotiana* species.

In various embodiments, the basis weight of the paper material forming a carton can range from about 50 g/m$^2$ to about 275 g/m$^2$ (e.g., about 175 g/m$^2$ to about 275 g/m$^2$) and the caliper can range from about 3 mils to about 200 mils. Further, the paper material can comprise about 80-95 (e.g., about 80-90) dry weight percent of the fibrous material, wherein the fibrous material can comprise about 5-100 (e.g., about 75-90) dry weight percent of fibers derived from a plant of the *Nicotiana* species.

In certain embodiments, the container described herein can further comprise a barrier material suitable to prevent moisture from reaching contents of the container, wherein the barrier material can comprise a paper substrate comprising about 85-90 dry weight percent of a second fibrous material, and wherein the second fibrous material can comprise about 5-100 (e.g., about 75-100) dry weight percent of fibers derived from a plant of the *Nicotiana* species.

Various embodiments of containers described herein can further comprise a wrapping material extending about a perimeter of the container. Also, the internal storage compartment of various embodiments of the containers described herein can contain a plurality of products selected from the group consisting of cigarettes, smokeless tobacco products, and food products. The top of a container can be removable from the body, or alternatively the top can be engaged with the body of the container. Containers described herein can be in any shape or size. In some embodiments, the top and body can be generally cylindrical.

A method of producing a fibrous material is also provided herein. The method can comprise combining a tobacco input from a plant of the *Nicotiana* species with a strong base, heating the combined tobacco input and strong base to form a tobacco pulp, forming at least one layer of tobacco pulp, drying the at least one layer of tobacco pulp, pressing the at least one layer of tobacco pulp to form a paper material and constructing at least one of a smoking article and a container that comprises the paper material. The paper material can comprise a fibrous material comprising at least 5 dry weight percent of fibers derived from a plant of the *Nicotiana* species, wherein the paper material can have a basis weight ranging from about 5 g/m$^2$ to about 450 g/m$^2$ and wherein the paper material can have a caliper ranging from about 0.01 mils to about 200 mils. The strong base can be selected from the group consisting of sodium hydroxide, potassium hydroxide, sodium carbonate, sodium bicarbonate, potassium carbonate, potassium bicarbonate, ammonium hydroxide, ammonium bicarbonate, ammonium carbonate, and combinations thereof.

In some embodiments, the tobacco pulp can further be exposed to a bleaching agent. Also, the layer of tobacco pulp can be dried to at least 10% moisture content or less. In certain embodiments, a plurality of layers can be pressed into a single paper product. Furthermore, a binder solution can optionally be applied to a surface of a layer of tobacco pulp to improve binding properties of the fibrous material.

These and other features, aspects, and advantages of the disclosure will be apparent from a reading of the following detailed description together with the accompanying drawings, which are briefly described below.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION

Figure 1:
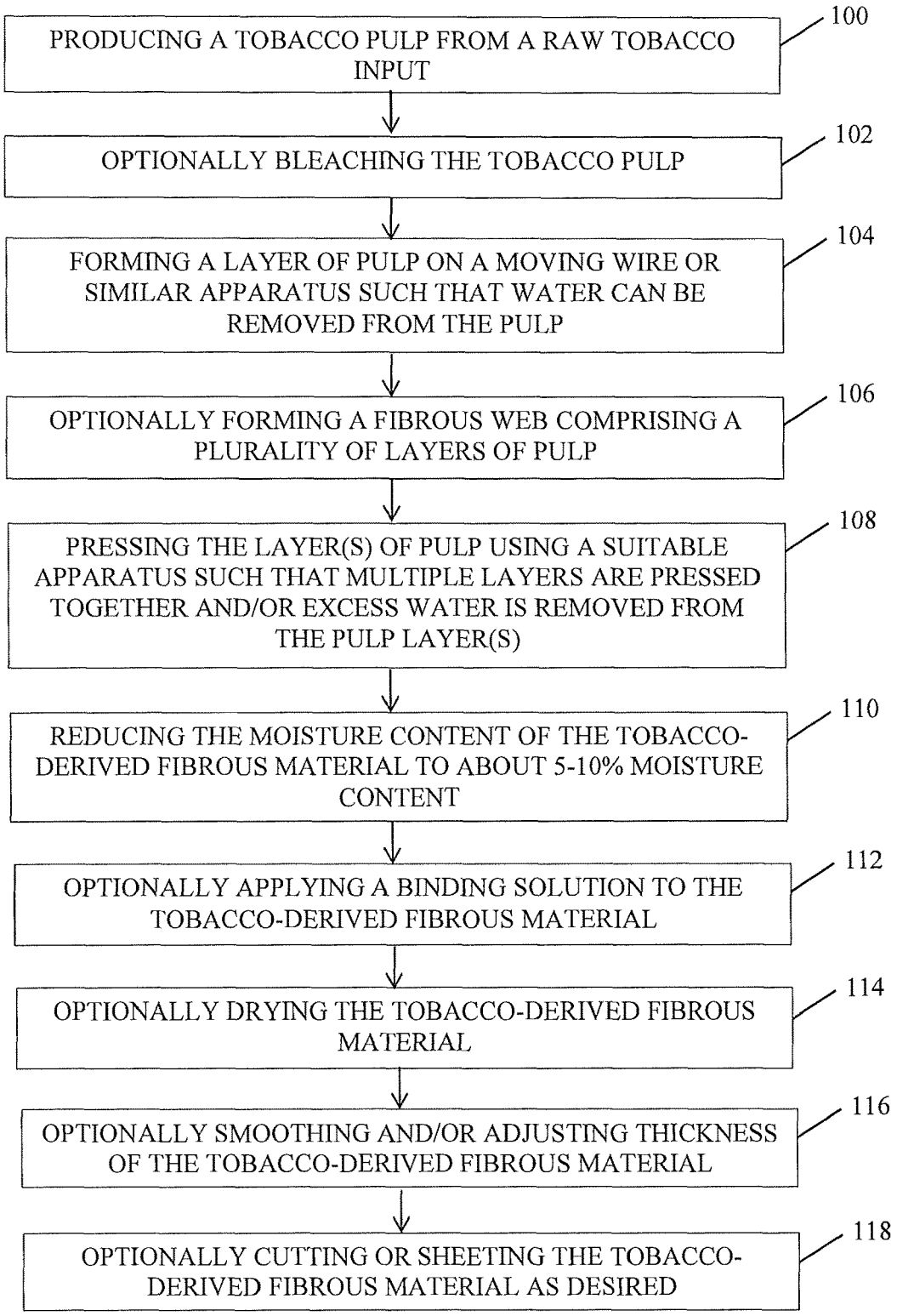
FIG. 1 is a block diagram of a method for producing a fibrous paper material derived from tobacco according to an example embodiment.

The present disclosure now will be described more fully hereinafter with reference to the accompanying drawings. The disclosure can be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

As described herein, embodiments of the disclosure relate to methods for producing paper from tobacco, and related systems, apparatuses, and products. In this regard, tobacco paper can be employed, for example, in tobacco products suitable for oral use and in packaging of tobacco and other consumer products. Conventional paper is a thin material produced by pressing together moist fibers, typically cellulose pulp derived from wood, rags or grasses, and drying them into flexible sheets. However, Applicants have determined that it can be desirable to produce paper that at least partially comprises pulp derived from a plant of the *Nicotiana* species.

As used herein, the term "paper" is meant to include any sheet or board made from a fibrous or cellulosic material and encompasses paperboard. As used herein, the term "paperboard" or "fiberboard" is used to refer to any solid, supportive material manufactured from a fibrous or cellulosic material such as, for example, cardboard or other paper product. Paperboard is generally a thicker form of paper. In various embodiments, the thickness of paper (i.e., caliper), is expressed in mils for paper and points for paperboard; however, both one mil and one point are equivalent to 0.001 inches. Density is expressed in mass per unit volume and bulk is the reciprocal of density. The tobacco paper products disclosed herein have various potential uses in tobacco products; however, possible uses of tobacco paper are not limited to the embodiments discussed herein.

Paper is conventionally produced from wood-derived pulp due to the relatively high cellulose content of wood. However, as described above, it can be desirable to instead produce paper from pulp derived from alternative sources, such as, for example, tobacco. Accordingly, the present disclosure provides methods for producing paper from a tobacco input and corresponding paper products comprising a tobacco input. More particularly, in some embodiments the tobacco input can comprise one or more components from a plant of the *Nicotiana* species including leaves, seeds, flowers, stalks, roots, and/or stems. The present invention can comprise harvesting a plant from the *Nicotiana* species and, in certain embodiments, separating certain components from the plant such as the stalks and/or roots, and physically processing these components. Although whole tobacco plants or any component thereof (e.g., leaves, flowers, stems, roots, stalks, and the like) could be used in the invention, it can be advantageous to use stalks and/or roots of the tobacco plant. For example, as described below, in some embodiments the tobacco input can comprise flue-cured tobacco stalks, burley tobacco stalks, and/or whole-plant tobacco biomass (e.g., extracted green tobacco biomass). The remainder of the description focuses on use of stalks and/or roots from the plant, but the invention is not limited to such embodiments.

The tobacco stalks and/or roots can be separated into individual pieces (e.g., roots separated from stalks, and/or root parts separated from each other, such as big root, mid root, and small root parts) or the stalks and roots may be combined. By "stalk" is meant the stalk that is left after the leaf (including stem and lamina) has been removed. "Root" and various specific root parts useful according to the present invention may be defined and classified as described, for example, in Mauseth, Botany: An Introduction to Plant Biology: Fourth Edition, Jones and Bartlett Publishers (2009) and Glimn-Lacy et al., Botany Illustrated, Second Edition, Springer (2006), which are incorporated herein by reference. The harvested stalks and/or roots are typically cleaned, ground, and dried to produce a material that can be described as particulate (i.e., shredded, pulverized, ground, granulated, or powdered). As used herein, stalks and/or roots can also refer to stalks and/or roots that have undergone an extraction process to remove water soluble materials. The cellulosic material (i.e., pulp) remaining after stalks and/or root materials undergo an extraction process can also be useful in the present invention.

Although the tobacco material may comprise material from any part of a plant of the *Nicotiana* species, in various embodiments, the majority of the tobacco input comprises material obtained from the stalks and/or roots of the plant. For example, in certain embodiments, the tobacco material comprises at least about 90%, at least about 92%, at least about 95%, or at least about 97% by dry weight of at least one of the stalk material and the root material of a harvested plant of the *Nicotiana* species.

The selection of the plant from the *Nicotiana* species (i.e., tobacco material) utilized in the products and processes of the invention can vary; and in particular, the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and *Galpao* tobaccos), Indian air cured, Red Russian and *Rustica* tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. Various representative types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al.; U.S. Pat. No. 7,025,066 to Lawson et al.; and U.S. Pat. No. 7,798,153 to Lawrence, Jr.; each of which is incorporated herein by reference. Tobacco compositions including dark air cured tobacco are set forth in U.S. Pat. No. 8,186,360 to Marshall et al., which is incorporated herein by reference. See also, types of tobacco as set forth, for example, in US Patent Appl. Pub. No. 2011/0247640 to Beeson et al., which is incorporated herein by reference.

Exemplary *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.×sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia* and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S.

Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO 2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference.

Further, in some embodiments the tobacco input can comprise reconstituted tobacco. Typically, tobacco stems are used in making such a reconstituted tobacco sheet, because the fibrous nature of those stems provides strength and structural integrity to the resulting sheet. See, for example, U.S. Pat. No. 3,398,754 to Tughan; U.S. Pat. No. 3,847,164 to Mattina; U.S. Pat. No. 4,131,117 to Kite; U.S. Pat. No. 4,182,349 to Selke; U.S. Pat. No. 4,270,552 to Jenkins; U.S. Pat. No. 4,308,877 to Mattina; U.S. Pat. No. 4,341,228 to Keritsis; U.S. Pat. No. 4,421,126 to Gellatly; U.S. Pat. No. 4,706,692 to Gellatly; U.S. Pat. No. 4,962,774 to Thomasson; U.S. Pat. No. 4,941,484 to Clapp; U.S. Pat. No. 4,987,906 to Young; U.S. Pat. No. 5,056,537 to Brown; U.S. Pat. No. 5,143,097 to Sohn; U.S. Pat. No. 5,159,942 to Brinkley et al.; U.S. Pat. No. 5,325,877 to Young; U.S. Pat. No. 5,445,169 to Brinkley; U.S. Pat. No. 5,501,237 to Young; and U.S. Pat. No. 5,533,530 to Young, which are incorporated herein by reference.

Production of paper derived from tobacco can involve a number of operations. For example, as illustrated in FIG. 1, a method of producing tobacco derived paper can comprise using raw tobacco materials to produce acceptable pulps at operation 100. Pulps can be produced from raw materials either mechanically or chemically. In a mechanical pulping process, raw tobacco materials can be chipped, and then fed between refiners where the chips are made into fibers between revolving metal disks, for example. Mechanical pulping does not separate the lignin from cellulose fibers, so the yield is often relatively high (i.e., above 95%). However, by not removing the lignin, the resulting paper can be brittle and exhibit lower strength.

For example, refiner mechanical pulping techniques can be used to produce tobacco stalk pulp. Raw tobacco stalk can be pretreated with water at a temperature of about 55° C. to about 65° C. for approximately 1.5-2 hours, for example. The weight ratio of water to stalk can be approximately 7:1. Pretreating the tobacco stalk can soften the stalk and remove water soluble extracts. The pretreated mixture can then be drained to about a 20% consistency. As used herein, the term "consistency" is defined as the percentage of solids in a mixture. This pretreated stalk can then be refined at atmospheric pressure with a plurality of passes through machine that can chip the stalk. See, for example, the machines discussed in U.S. Pat. No. 3,661,192 to Nicholson et al.; U.S. Pat. No. 3,861,602 to Smith et al.; U.S. Pat. No. 4,135,563 to Maucher; and U.S. Pat. No. 5,005,620 to Morey, each of which is incorporated by reference herein. In various embodiments, the machines can be calibrated such that the targeted size of the stalk chips can decrease which each successive pass. These chipped pulps can then be refined in a PFI mill to various levels, for example. See, for example, the methods and apparatuses discussed in U.S. Pat. No. 6,773,552 to Albert et al.; and U.S. Appl. Pub. No. 2010/0036113 to Mambrim Filho et al.

In some embodiments, a chemical pulping process can be used in the tobacco papermaking process. A chemical pulping process separates lignin from cellulose fibers by dissolving lignin in a cooking liquor such that the lignin, which binds the cellulose fibers together, can be washed away from the cellulose fibers without seriously degrading the cellulose fibers. There are three main chemical pulping processes known in the art. Soda pulping involves cooking raw material chips in a sodium hydroxide cooking liquor. The kraft process evolved from soda pulping and involves cooking raw material chips in a solution of sodium hydroxide and sodium sulfide. The acidic sulfite process involves using sulfurous acid and bisulfate ion in the cook. The kraft process is the most commonly used method for chemical wood pulping; however, the soda process can also be used to produce some hardwood pulps. Any chemical pulping process, including, but not limited to the three examples listed above, can be used to produce a tobacco pulp from raw tobacco materials.

A cooking liquor can comprise a strong base. As used herein, a strong base refers to a basic chemical compound (or combination of such compounds) that is able to deprotonate very weak acids in an acid-base reaction. For example, strong bases that can be useful in the present invention include, but are not limited to one or more of sodium hydroxide, potassium hydroxide, sodium carbonate, sodium bicarbonate, potassium carbonate, potassium bicarbonate, ammonium hydroxide, ammonium bicarbonate, and ammonium carbonate. In some embodiments, the weight of the strong base can be greater than about 5%, greater than about 25%, or greater than about 40% of the weight of the tobacco input. In certain embodiments, the weight of the strong base can be less than about 60% or less than about 50% of the weight of the tobacco input. In still further embodiments, the weight of the strong base can be from about 5% to about 50%, or from about 30% to about 40% of the weight of the tobacco input. Various other chemicals and weight ratios thereof can also be employed to chemically pulp the tobacco input in other embodiments.

In addition to combining a tobacco input with a strong base, chemically pulping a tobacco input can include heating the tobacco input and the strong base. Heating the tobacco input and the strong base can be conducted to increase the efficacy of the chemical pulping. In this regard, an increase in either cooking temperature or time will result in an increased reaction rate (rate of lignin removal). To make calculations involving chemical pulping simpler, chemical pulping is herein discussed in terms of a parameter called the H-factor, which takes into account both the temperature and time of the chemical pulping operation. The equation for calculating an H-factor is provided below:

$$H=\int_0^t \exp(43.2-16115/T)dt, \quad \text{(Equation 1):}$$

wherein:

T=temperature (in Kelvin), and t=time (in minutes).

Thus, the H-factor refers to the area contained by a plot of reaction rate versus time. In some embodiments heating the tobacco input and the base can be conducted with an H-factor greater than 500, an H-factor greater than about 900, an H-factor greater than 2,000, an H-factor less than 3,500, an H-factor from about 500 to about 3,300, an H-factor from about 900 to about 1,110, or an H-factor from about 1,000 to about 2,500. Further, in some embodiments the tobacco input and the strong base can be heated to a maximum temperature greater than about 150° C., greater than about 175° C., from about 150° C. to about 180° C., or from about 160° C. to about 170° C. The maximum temperature can be reached at greater than about 45 minutes, greater than about 60 minutes, less than about 65 minutes, from about 60 to about 65 minutes, or from about 55 to about 70 minutes.

For example, a method of producing tobacco-derived pulp can comprise soda pulping a tobacco input to form a tobacco pulp. Raw tobacco materials can be cooked with a 20-40% NaOH solution. The ratio of cooking liquor to stems can be, for example, from about 6:1 to about 8:1. This mixture can be heated to a maximum temperature of about 150° C. to about 175° C. at approximately 60-90 minutes and cooked at the maximum temperature for about 40 minutes to about 180 minutes, for example. The soda pulping can have an H-factor of about 800 to about 1,100.

In some embodiments, a method of producing tobacco-derived pulp can comprise kraft pulping a tobacco input to form a tobacco pulp. Raw tobacco materials can be cooked with a liquor comprising about 15-25% $Na_2O$ and about 20-30% sulfidity. The ratio of cooking liquor to stems can be, for example, from about 8:1 to about 10:1. This mixture can be heated to a maximum temperature of about 160° C. to about 180° C. at approximately 60-150 minutes and cooked at the maximum temperature for about 110 to about 150 minutes, for example. The resulting pulps can have about a 42-45% yield, for example.

The method of producing a tobacco-derived pulp can include one or more additional operations in some embodiments. See, e.g., U.S. Patent Appl. Pub. No. 2013/0276801 to Byrd Jr. et al., herein incorporated by reference in its entirety. For example, the tobacco input can undergo further processing steps prior to pulping and/or the pulping method can include additional treatment steps (e.g., drying the tobacco input, depithing the tobacco input, milling the tobacco input, etc.). In some embodiments, these additional steps can be conducted to remove pith (which comprises lignin) from the tobacco input and/or tobacco pulp manually, and thus reduce the amount of chemicals necessary to delignify the tobacco input during a chemical pulping process, for example. Mixing water with the tobacco pulp to form a slurry and filtering the slurry can be conducted, for example, to remove some of the non-cellulosic materials, such as pith, parenchyma, and tissue from the tobacco pulp. Additional treatment steps (e.g., milling the tobacco input) can be conducted to increase the surface area of the tobacco input such that the efficacy of a pulping and/or a bleaching operation is increased. Steam- or water-based pre-hydrolysis of the tobacco stalk prior to pulping, for example, can reduce the amount of chemicals necessary in a bleaching operation. Anthraquinone can be employed in a chemical pulping method in an attempt to provide a higher yield by protecting carbohydrates from the strong base during delignification, for example. Other processing steps known in the papermaking art can be employed in pulping the raw tobacco input.

As illustrated in FIG. 1, for example, a tobacco paper making method can optionally include exposing the tobacco pulp to a bleaching agent at operation 102. The bleaching operation can be conducted to remove the residual non-cellulosic materials left over after pulping without damaging the cellulose. Exemplary processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 4,143,666 to Rainer; U.S. Pat. No. 4,194,514 to Campbell; U.S. Pat. No. 4,366,824 to Rainer et al.; U.S. Pat. No. 4,388,933 to Rainer et al.; and U.S. Pat. No. 4,641,667 to Schmekel et al.; and PCT WO 96/31255 to Giolvas, all of which are incorporated by reference herein.

Bleaching the tobacco pulp can comprise chlorination of the tobacco pulp with a chlorine dioxide solution and caustic extraction of the tobacco pulp with a second strong base (e.g., one or more of sodium hydroxide, potassium hydroxide, sodium carbonate, sodium bicarbonate, potassium carbonate, potassium bicarbonate, ammonium hydroxide, ammonium bicarbonate, and ammonium carbonate). Note that the strong base employed in caustic extraction (the "second strong base") may or may not be the same as the strong base employed in chemical pulping. Various alternate and additional chemicals can also be employed to bleach the tobacco input in other embodiments. For example, the chlorine dioxide solution can further comprise sulfuric acid. Other alternate or additional bleaching chemicals include sodium chlorate, chlorine, hydrogen peroxide, oxygen, ozone, sodium hypochlorite, hydrochlorous acid, hydrochloric acid, phosphoric acid, acetic acid, nitric acid, and sulphite salts. In embodiments employing chlorine, chlorate, or chlorite, chlorine dioxide can be produced by exposure of these chemicals to acidic conditions.

The methods described above provide operations configured to produce dissolving grade pulp from tobacco. Dissolving grade pulp is pulp which comprises a sufficient percentage of alpha cellulose necessary for the production of paper (e.g., greater than 85% by weight, typically greater than 88%, or more typically greater than 90% alpha cellulose). The quantity of hemicelluloses (complex polymers composed of various five and six-carbon sugars in a highly branched structure) may also be low (e.g., from about 0.5% to about 10% by weight) in dissolving grade pulp. Additionally, the quantity of lignin in dissolving grade pulp may also be very low (e.g., from about 0% to about 0.2% by weight). Further characteristics of dissolving grade pulp may include: pentosan (from about 0% to about 5% by weight), ash (from about 0% to about 0.15% by weight), alcohol-benzene extractives (from about 0% to about 0.5% by weight), brightness (about 85% or greater), viscosity (from about 5% to about 25%, 1% Cuprammonium), and a copper number from about 0.1 to about 1.2. Dissolving grade pulp can also be suitable for subsequent chemical conversion into other products beyond paper, including microcrystalline cellulose, cellulose acetate, rayon, cellophase, cellulose nitrate, carboxymethyl cellulose, and viscose. In this regard, while the disclosure is generally described in relation to the production of paper, various other products may also be produced in accordance with the methods disclosed herein.

Various parameters can be used to characterize the pulp and its quality in regard to papermaking. Kappa number is a parameter that can be used to characterize pulp used in the production of paper. Kappa number is a measure of the residual lignin content in pulp. A lower value indicates lower lignin content. More severe cooking conditions (e.g., more chemicals, higher temperatures, etc.) can cause the kappa number to drop. Depending on the type of paper product intended, kappa numbers can vary. For example, target kappa numbers for bleachable pulps can be about 10 to about 50, or about 15 to about 30. Target kappa numbers for sack paper pulps can be, for example, about 30 to about 70, or about 45 to about 55. Target kappa numbers for corrugated paperboard can be, for example, about 35 to about 115, or about 60 to about 90. Pulp viscosity can also be used to measure the degree of polymerization of cellulose.

Pulp viscosity can be determined by dissolving the cellulose in a cupriethylenediamin solution. A higher viscosity indicates a higher degree of polymerization as well as higher fiber strength. Pulp viscosity drops with decreasing kappa number. In certain embodiments, kraft pulping can produce pulp with a higher viscosity and thereby a higher fiber strength than soda pulping.

Freeness level is an indicator of the drainage rate of pulp. The higher the value, the easier it is to drain the pulp in the papermaking process. Freeness levels can be indicated as a CSF (Canadian Standard Freeness) value. Refining pulp can decrease the freeness level of the pulp. In addition, freeness level can be sensitive to the water quality used during measurement. Conventional unrefined softwood pulp can have a freeness level of about 700 to about 760 CSF, for example. Conventional unrefined hardwood pulp can have a freeness level of about 500 to about 600 CSF, for example. The freeness level of pure tobacco pulp can have a range of about 0 to about 500 CSF.

Pulp handsheets can be used for testing of pulp quality in regard to making paper. TAPPI (Technical Association of the Pulp and Paper Industry) standard handsheets are 60 od g/m$^2$. Handset testing can include measuring basis weight, caliper (thickness), and various other paper characteristics described in more detail below. Various test methods known in the art can be used to measure characteristics of the handsheets and paper products, as discussed below.

Once a suitable pulp is achieved, the pulp can optionally be refined to modify the surface structure of the fibers. Refining can physically modify fibers to fibrillate and make the fibers more flexible, such that better bonding can be achieved. Refining can increase the tensile and burst strength of a final paper product, but it can also decrease the tear strength. As discussed above, refining can also decrease the freeness level of pulp. For example, swelling in water expands the fibers' surface area, which can increase fiber strength and the ability of the fibers to consolidate, but in turn make later drying of the pulp more difficult. As such, additives can be used to increase the water repellency of the fibers, for example.

Additionally, other additives known in the art can be used to alter characteristics of the pulp fibers. For example, fillers (e.g., chalk or china clay) can be added to the pulp to improve printing and/or writing characteristics of the final paper product. Other papermaking techniques known in the art can be used to prepare the pulp for a papermaking machine. In various embodiments, wood pulp can be combined with tobacco pulp to improve characteristics of the finished paper product.

There are a variety of paper and paperboard grades that can be tailored for a particular end use. For certain board grades, different finish types can comprise actual layers of the board. Exemplary processes for making paper are discussed, for example, in U.S. Pat. No. 2,795,545 to Gluesenkamp; U.S. Pat. No. 3,224,927 to Brown; U.S. Pat. No. 3,253,978 to Bodendorf; U.S. Pat. No. 3,647,684 to Malcolm; U.S. Pat. No. 4,210,490 to Taylor; U.S. Pat. Nos. 4,385,961 and 4,388,150 to Sunder et al.; U.S. Pat. No. 4,643,801 to Johnson; U.S. Pat. No. 4,749,444 to Aktiengesellschaft; U.S. Pat. No. 4,753,710 to Langley et al.; and U.S. Pat. No. 5,071,512 to Bixler et al, all of which are incorporated by reference herein. Various machines known in the art can be used in a papermaking process. Exemplary machines used to make paper are discussed, for example, in U.S. Pat. No. 3,691,010 to Krake; U.S. Pat. No. 4,102,737 to Morton; U.S. Pat. No. 6,248,210 to Edwards et al.; U.S. Pat. No. 7,291,249 to Thoröe-Scherb et al.; U.S. Pat. No. 8,377,262 to Quigley; and U.S. Pat. No. 8,414,741 to Klerelid et al, all of which are incorporated by reference herein.

In general, processing on a papermaking machine can begin with forming a layer of entangled fibers on a moving wire. As illustrated in FIG. 1 for example, as the entangled fibers are moved along the wire, water can be removed by gravity and vacuum assisted drainage at operation 104. In certain embodiments, a plurality of layers of pulp in a wet state can be consolidated into a single web at operation 106. Furthermore, each layer can have a specified stock composition depending on the layer's intended purpose in the paper or paperboard construction. As layers are combined, they can be pressed together between hard press rolls at operation 108. This pressing process can remove additional water, and sometimes can be vacuum assisted. The moisture content of the paper web after pressing can be about 65% or less. Following pressing, the sheet can be passed over steam-heated steel cylinders at operation 110, thereby reducing the moisture content to about 5 to about 10%. A starch solution, or a similar binding solution, can optionally be applied to the paper or paperboard surface at operation 112 to improve strength and firmly bind the fibers. Optional drying can be applied to the web at operation 114 if necessary. Steel rollers can optionally be used to improve smoothness and adjust thickness of the web at operation 116 if necessary. The reels of paper discharged from the machine can be cut into smaller reels or sheeted as desired at operation 118. It should be noted that paper used for cigarettes and cigarette packaging must meet food packaging standards.

In various embodiments, the surface of the paper web can be coated to improve the surface for printing. Pigmented coatings consisting of mineral pigments and binders dispersed in water can be used, for example. Additional layers of coatings can be applied to achieve the required appearance, color, and/or smoothness.

Several characteristics known in the art can be used to characterize paper. As mentioned above, basis weight and caliper are two parameters used to characterize paper. In some embodiments, the basis weights of tobacco paper described herein can range from about 5 to about 450 g/m$^2$, about 15 to about 30 g/m$^2$, about 45 to about 75 g/m$^2$, about 50 to about 125 g/m$^2$, about 125 to about 200 g/m$^2$, about 175 to about 250 g/m$^2$, about 200 to about 300 g/m$^2$, or about 300 to about 450 g/m$^2$. In some embodiments, the basis weights of tobacco paper described herein can range from about 10 to about 150 g/m$^2$ (e.g., about 15 to about 120 g/m$^2$, about 10 to about 75 g/m$^2$, about 25 to about 45 g/m$^2$. In certain embodiments, the basis weights of tobacco paper can range from about 10 to about 275 g/m$^2$ (e.g., about 10 to about 75 g/m$^2$, or about 50 to about 275 g/m$^2$). The caliper of tobacco paper described herein can range from about 0.01 to about 200 mils, about 0.01 to about 100 mils, about 0.01 to about 15.0 mils, about 1.0 to about 8 mils, about 1.0 to about 5 mils, or about 1 to about 2.5 mils for example.

Tearing resistance is another parameter that can be used to characterize paper. Tearing strength can be heavily dependent upon average fiber length. Tearing strength trends can be confusing. For softwood, the tearing strength normally drops steadily as refining progresses. For mixed hardwoods, tearing strength rises briefly, then decreases steadily. For monospecies hardwoods like *eucalyptus*, tear strength rises steadily with refining. In various embodiments of tobacco paper made according to methods described herein, tearing strength can remain fairly consistent across a range of refining freeness values. In some embodiments, tear index (tear strength normalized by dividing it by the sheet basis weight) of tobacco paper can be about 4.0 to about 6.5 $mN*m^2/g$, or about 4.25 to about 5.75 $mN*m^2/g$.

Tearing resistance/strength of paper and paperboard can be tested according to TAPPI test method T414, for example. This method measures the force perpendicular to the plane of the paper required to tear multiple plies through a specified distance after the tear has been started using an Elmendorf-type tearing tester. It does not measure edge-tear resistance. The measured results can be used to calculate the approximate tearing resistance of a single sheet.

The tensile strength of paper sheets is an important paper property. It is taken as a direct measure of the bonded strength of the sheet. Fiber length and wall thickness play a key role in bonding strength. Typical tensile index (tensile strength normalized by dividing it by the sheet basis weight) values for conventional wood-derived paper in the literature range from 20-70 Nm/g. In various embodiments, tobacco paper described herein can have a tensile strength that is lower than softwood tensile strengths, but comparable to hardwood tensile strengths. For example, tobacco-derived paper can have a tensile index of about 35 to about 70 Nm/g, or about 40 to about 65 Nm/g.

Tensile properties of paper and paperboard can be tested according to TAPPI test method T494, for example. This test method uses constant-rate-of-elongation equipment for determining four tensile breaking properties of paper and paperboard: tensile strength, stretch, tensile energy absorption and tensile stiffness. Tensile strength (as used here) is the force per unit width of a test specimen before rupture. The stretch (or percentage elongation) is expressed as a percentage, i.e., one hundred times the ratio of the increase in length of the test specimen to the original test span before rupture. Tensile energy absorption (TEA) is expressed as energy per unit area (test span×width) of test specimen and is a measurement of the work done when a specimen is stressed to rupture in tension under prescribed conditions. Tensile stiffness is the ratio of tensile force per unit width to tensile strain within the elastic region of the tensile-strain relationship. The elastic region of the tensile-strain relationship is the linear portion of the load-elongation relationship up to the elastic limit. The elastic limit is the maximum tensile force above which the load-elongation relationship departs from linearity. Zero-span tensile strength indicates the strength of the individual fibers in a paper sample rather than the strength of the final paper product. Fiber strength can be measured prior to forming a paper product. Alternatively, a sheet of paper can be rewetted to eliminate the effect of fiber bonding, thereby allowing for the fiber strength to be estimated.

As discussed above, Tensile Energy Absorption (TEA) combines tensile strength and the amount that the sample stretched prior to tensile failure. It is a measure of the "toughness" of the sheet—its ability to absorb energy before failing. In various embodiments, tobacco paper described herein can have TEA values of about 0.1 to about 1.0 J/g, or about 0.5 to about 0.95 J/g.

Bursting strength of paper is another important characteristic. In various embodiments of tobacco paper described herein, burst index (bursting strength normalized by dividing it by basis weight) can be about 3.0 to about 5.0 $kPa*m^2/g$, or about 3.0 to about 4.5 $kPa*m^2/g$. Bursting strength of paper and paperboard can be tested according to TAPPI test method T403, for example. This method is designed to measure the maximum bursting strength of paper and paper products having a busting strength of about 50 kPa up to about 1200 kPa and in the form of flat sheets of up to 0.6 mm thick. For testing paperboard, TAPPI test method T807 can be used. For testing tissue paper, TAPPI test method T570 can be used. For test method T403, the test specimen can be held between annular clamps and subjected to increasing pressure by a rubber diaphragm which is expanded by hydraulic pressure at a controlled rate until the specimen ruptures. The maximum pressure reading up to the rupture point is recorded as the bursting strength.

Scott internal bond of paper and paperboard can be tested according to TAPPI test method T833, for example. This method determines the internal bonding strength of paper or paperboard by measuring the average energy required to separate the specimen into two plies through the use of a mechanical instrument. The internal bond test is used to indicate the resistance to forces which tend to separate the fibers within a ply or between plies in a sheet of paperboard. In various embodiments, tobacco paper has a Scott internal bond of about 1.0 to about 6.0.

Bending resistance (stiffness) of paper and paperboard can be tested according to TAPPI test method T489. This test measures the resistance to bending of paper and paperboard. The test method is used to determine the bending moment required to deflect the free end of a 38 mm (1.5 inches) wide vertically clamped specimen 15° from its center line when the load is applied 50 mm (1.97 inches) away from the clamp. The resistance to bending is calculated from dividing the bending moment (mN·m) by the length (m), resulting in the force (mN) required to deflect the sample through the specified distance. In various embodiments, tobacco paper can have Taber Stiffness values of about 0.1 to about 95 Tabor Stiffness units, about 0.1 to about 2.0 Tabor Stiffness units, about 0.5 to about 1.5 Tabor Stiffness units, about 55 to about 90 Tabor Stiffness units, or about 55 to about 70 Tabor Stiffness units.

Folding endurance of paper and paperboard can be tested according to TAPPI test method T511, for example. A MIT-type apparatus can be used to determine the folding endurance of paper. Folding endurance is defined as the logarithm (the base 10) of the number of double folds required to break the paper when a strip of paper 15 mm (0.59 inches) wide is tested under a standard tension of 9.81 N. A double fold is defined as one complete oscillation of the test piece, during which it is folded first backwards then forwards about the same line. In various embodiments, tobacco paper described herein can have about 3000 to about 20,000 MIT double folds at 0.5 kg loading. In various embodiments, tobacco paper described herein can have about 2000 to about 5,000 MIT double folds at 1.0 kg loading.

The roughness of paper is another important characteristic. Parker roughness of paper and paperboard can be tested according to TAPPI test method T555, for example. Higher values correlate to rougher, or less smooth, paper surfaces. Smoothness often increases with refining. Test method T555 measures the roughness of paper and paperboard under conditions intended to simulate the pressures and backing substrates found in printing processes. It is applicable to coated and uncoated papers and paperboards. The resistance to flow of air between the test surface and a metal band in contact with it is measured under conditions intended to simulate printing process conditions. In various embodiments, tobacco paper can have a Parker roughness value of about 5.0 to about 8.0.

Water absorptiveness (Cobb value), is a function of various characteristics of paper or board such as sizing, porosity, etc. Specifically, the Cobb value is the mass of water absorbed in a specific time by a 1 square meter of paper or paperboard under 1 cm of water. In various embodiments, tobacco paper can have a Cobb value of about 50 to about 200 g/m$^2$, or about 75 to about 150 g/m$^2$. Cobb water absorption of paper and paperboard can be tested according to TAPPI test method T441, for example. This method describes a procedure for determining the quantity of water absorbed by nonbibulous paper, paperboard, and corrugated fiberboard in a specified time under standardized conditions.

Figure 2:
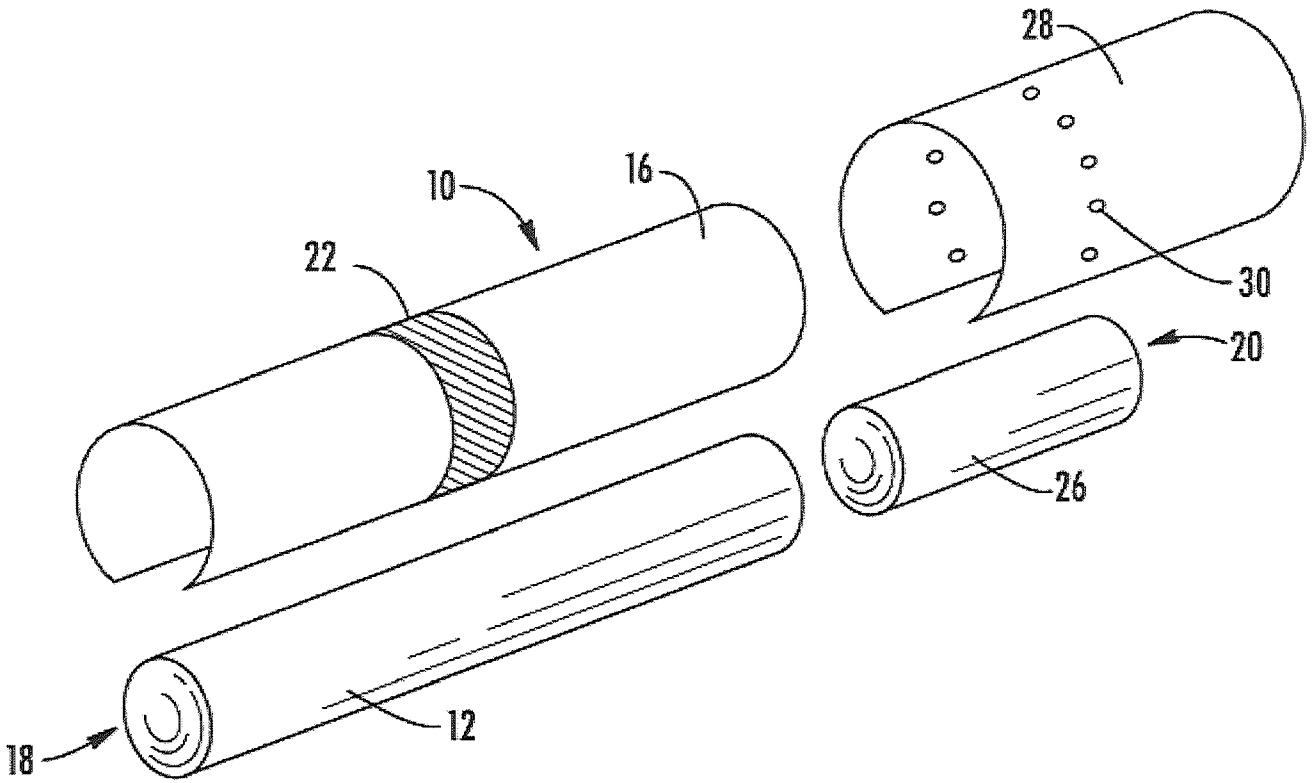
FIG. 2 is an exploded perspective view of a smoking article having the form of a cigarette, showing the smokable material, the wrapping material components, and the filter element of the cigarette.

In various embodiments, tobacco paper can be used in a tobacco product as provided herein. Referring to FIG. 2, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. The filter element 26 is circumscribed along its outer circumference or longitudinal periphery by a layer of outer plug wrap 28. The filter element 26 is attached to the tobacco rod 12 using tipping material (not pictured) that circumscribes both the entire length of the filter element 26 and an adjacent region of the tobacco rod 12. Examples of tipping materials are described, for example, in U.S. Pat. No. 7,789,089 to Dube et al., and in U.S. Pat. App. Publ. Nos. 2007/0215167 to Crooks et al., 2010/0108081 to Joyce et al., 2010/0108084 to Norman et al., and 2013/0167849 to Ademe et al.; and PCT Pat. App. Pub. No. 2013/160671 to Dittrich et al., each of which is incorporated by reference herein. The inner surface of the tipping material is fixedly secured to the outer surface of the plug wrap 28 and the outer surface of the wrapping material 16 of the tobacco rod, using a suitable adhesive; and hence, the filter element and the tobacco rod are connected to one another. A ventilated or air diluted smoking article can be provided with an optional air dilution means, such as a series of perforations 30, each of which extend through the tipping material and plug wrap 28. Various types of cigarette papers are disclosed and referenced, for example, in U.S. Pat. No. 5,220,930 to Gentry, herein incorporated by reference in its entirety.

In various embodiments, the tipping material used to form a smoking article can be made from tobacco paper. The tobacco paper used as the tipping material can be formed from fibrous pulp comprising about 5 dry weight percent tobacco based-pulp or more. In a preferred embodiment, the fibrous pulp can comprise about 40 to about 60 dry weight percent tobacco-based pulp. The remaining portion of the fibrous pulp can be wood based pulp, for example. In various embodiments, papermaking additives can be combined with the pulp such that the tipping material comprises about 55-70 dry weight percent fiber materials, the balance being papermaking additives known in the art. In some embodiments, tipping material basis weights can range from about 20 to about 50 g/m$^2$, or about 25 to about 45 g/m$^2$ (e.g., about 28 to about 41 g/m$^2$). In some embodiments, caliper of a tipping material can range from about 1.0 mils to about 6.0 mils. In various embodiments, tipping material can have a Gurley Porosity from about 4 to about 1800 secs/100 mL. In some embodiments, a tipping material can have a CORESTA Porosity from about 1 to about 200 CU's. In various embodiments, a tipping material can have a Diffusion Capacity from about 0.100 to about 1.800 cm/s.

In various embodiments, the plug wrap used to form a smoking article can be made from tobacco paper. The tobacco paper used as the plug wrap can be formed from fibrous pulp comprising about 5 dry weight percent tobacco based-pulp or more. In a preferred embodiment, the fibrous pulp can comprise about 40 to about 60 dry weight percent tobacco-based pulp. The remaining portion of the fibrous pulp can be wood based pulp, for example. Papermaking additives can be combined with the pulp such that the plug wrap paper comprises about 55-90 dry weight percent fiber materials, the balance being papermaking additives known in the art such as binders, fillers, etc. In various embodiments, a plug wrap can have a filler level from about 0 to about 16 dry weight percent. In some embodiments, plug wrap paper basis weights can range from about 10 to about 130 g/m$^2$ (e.g., about 18 to about 120 g/m$^2$). In some embodiments, caliper of a plug wrap can range from about 1.0 mils to about 6.0 mils. In various embodiments, a plug wrap material can have a Diffusion Capacity from about 0.005 to about 3.300 cm/s.

In various embodiments, the wrapping material used to form a smoking article can be made from tobacco paper. In some embodiments, a fibrous material that can be used as a wrapping material can also be used as a cigarette paper that a smoker can use to roll their own smoking articles. The tobacco paper used as the wrapping material can be formed from fibrous pulp comprising about 5 dry weight percent tobacco based-pulp or more. In a preferred embodiment, the fibrous pulp can comprise about 5 to about 20 dry weight percent tobacco-based pulp. In an embodiment, the wrapping material is formed from fibrous pulp comprising about 10 dry weight percent tobacco fibers. The remaining portion of the fibrous pulp can be wood based pulp, for example. Papermaking additives can be combined with the pulp such that the wrapping material comprises about 55-70 dry weight percent fiber materials, the balance being papermaking additives known in the art. In some embodiments, wrapping material basis weights can range from about 10 to about 75 g/m$^2$ (e.g., 12 to about 72 g/m$^2$). In some embodiments, a wrapping material (also referred to as a cigarette paper) can have a CORESTA Porosity from about 5 to about 130 CU's. In various embodiments, a tipping material can have a Diffusion Capacity from about 0.300 to about 2.000 cm/s. In some embodiments, caliper of cigarette paper can range from about 1.0 mils to about 6.0 mils.

In various embodiments of the present invention, tobacco paper can be used to fabricate containers and packaging materials. The container embodiments described in the present application can be used to store any solid products, but are particularly well-suited for products designed for human use or oral consumption. Exemplary consumable products that are often packaged in such containers include a wide variety of consumer products, food products, and tobacco products. The number of solid product units stored in the containers of the disclosure can also vary, depending on the size of the container and the size of the product units. Consumer products and food products include any product that is susceptible to environmental pressures and exhibit moisture sensitivity. Exemplary consumer products include, but are not limited to, baby powder, beverages, potato chips, nuts, juice, baby formula, powdered cleansers or detergents, cereal, pizza, hamburgers, chicken, french fries, cookies, crackers, danishes, and cookie dough.

Exemplary tobacco products that can be packaged in containers fabricated from tobacco paper include cigarettes, cigars, pelletized tobacco products (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like. Further, exemplary tobacco products include tobacco formulations in a loose form such as, for example, a moist snuff product. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. Smokeless tobacco compositions utilized as the product contained in the containers of the disclosure will often include such ingredients as tobacco (typically in particulate form), sweeteners, binders, colorants, pH adjusters, fillers, flavoring agents, disintegration aids, antioxidants, oral care additives, and preservatives. See, for example, U.S. Pat. No. 7,861,728 to Holton et al., which is incorporated by reference herein in its entirety.

The shape of the outer surface of the containers of the disclosure can vary. Although the container embodiments illustrated in the drawings have certain contours, containers with other exterior surface designs could also be used. For example, the sides or edges of the containers of the disclosure could be flattened, rounded, or beveled, and the various surfaces or edges of the container exterior could be concave or convex. Further, the opposing sides, ends, or edges of the container can be parallel or non-parallel such that the container becomes narrower in one or more dimensions.

Figure 3:
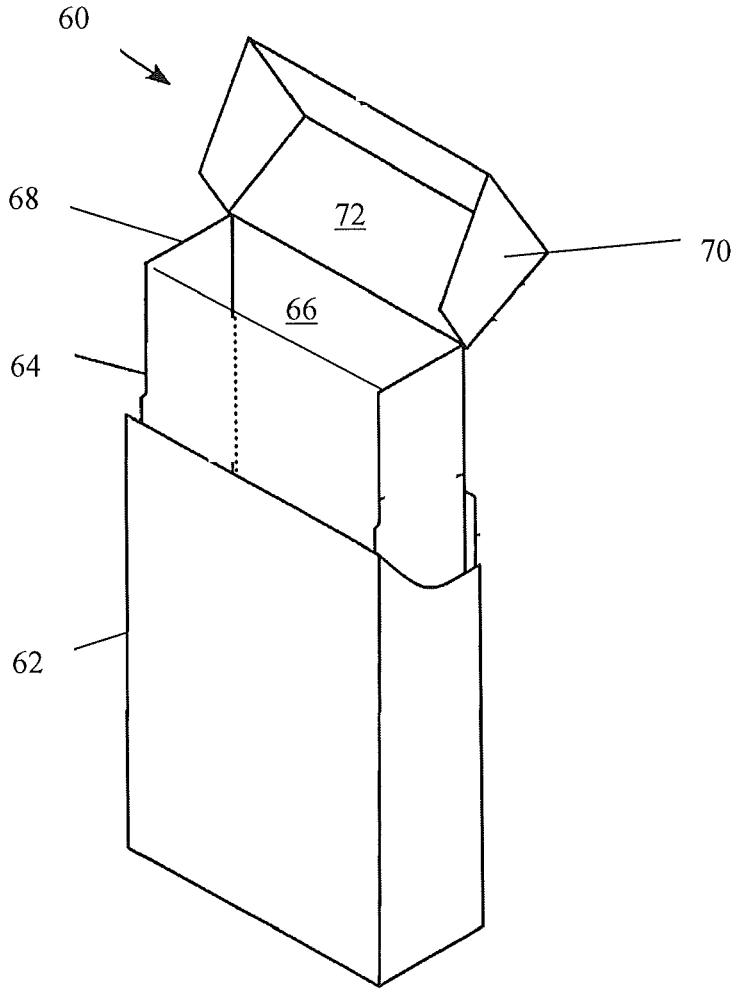
FIG. 3 is a perspective view of a cigarette container embodiment of the present disclosure.

FIG. 3 is a perspective view of a container embodiment of the present disclosure. In this embodiment, a cigarette container or "carton" 60 is illustrated. The container 60 has an outer casing 62 and an inner frame 64 having an inner frame surface 66. The inner frame 64 protrudes from the upper end of the outer casing 62 and forms an opening 68 in cooperation with the outer casing 62. In this illustrated, exemplary embodiment, the container 60 further includes a lid 70 having an inner lid surface 72, which is integrally jointed to a rear edge of the opening end 68 of the inner frame 62 with a self hinge. The lid 70 is therefore rotatable around an axis of the self hinge. In an alternative embodiment (not shown), the lid is completely removable and replaceable. Examples of cartons and other containers are described, for example, in U.S. Pat. No. 4,742,955 to Focke et al; U.S. Pat. No. 4,753,384 to Focke et al.; U.S. Pat. No. 4,852,734 to Allen et al.; U.S. Pat. No. 5,193,674 to Cobler et al.; U.S. Pat. No. 5,333,729 to Wolfe et al.; U.S. Pat. No. 5,379,889 to Cobler; U.S. Pat. No. 5,682,986 to Cobler; U.S. Pat. No. 5,788,066 to Focke et al.; U.S. Pat. No. 5,806,671 to Focke et al.; U.S. Pat. No. 6,360,943 to Focke et al.; U.S. Pat. No. 7,617,930 to Jones et al.; and U.S. Appl. Pub. 2013/0286452 to Hugonnet; each of which is incorporated by reference herein. It is noted that a cigarette package can be in softpack or hardpack form, as is known in the art.

The outer casing 62 and inner frame 64 may be manufactured from paper, paperboard, cardboard, or thin foil or metal. Accordingly, cigarette containers or cartons can be fabricated from tobacco paper disclosed herein. The outer casing 62 may optionally include a label or wrapper on an outer face which can also be fabricated from tobacco paper disclosed herein. According to one embodiment, containers can then be sealed via application of a circumferential outer layer. Typically, the selection of the packaging outer layer, label or wrapper is dependent upon factors such as aesthetics, branding or advertising, and desired barrier properties so as to provide additional protection from exposure to the atmosphere and ingress or regress of moisture. The outer casing 62 and inner frame 64 may be prepared by known processes from a "blank" as described in U.S. Pat. No. 5,699,903 to Focke et al.; U.S. Pat. No. 5,161,733 to Latif; U.S. Pat. No. 5,379,889 to Cobler; U.S. Pat. No. 7,484,619 to Boriani et al; and U.S. Pat. No. 8,016,105 to Sendo, each of which is incorporated by reference herein. In one embodiment, the outer casing 62 is manufactured separately and subsequently superimposed and adhered to the inner frame 62. Alternatively, the outer casing 62 and inner frame 64 are manufactured simultaneously as one blank.

Figure 4:
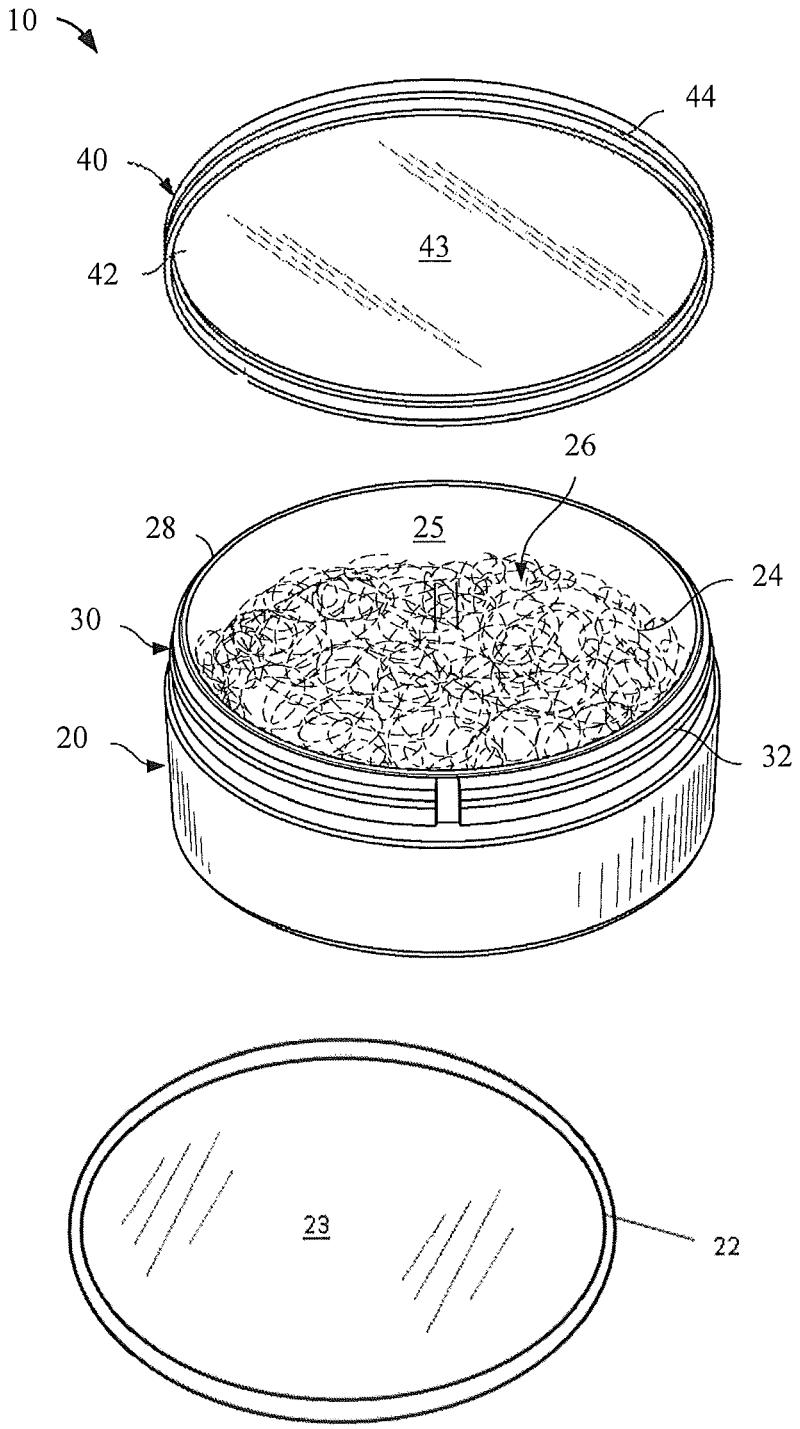
FIG. 4 is a perspective view of a smokeless tobacco container embodiment of the present invention.

FIG. 4 illustrates another embodiment of a container in accordance with the present disclosure. In this embodiment, a smokeless tobacco container 10 is illustrated. The container 10 may be formed by an open-ended body 20 and a cover 40. The body 20 has a bottom wall which, in some instances, may be substantially circular, and a side wall 24 having an inner surface 25 facing the tobacco product. The side wall 24 depends from a bottom wall 22 which has an inner surface 23 and, in some instances, may be cylindrical as shown. The side wall 24 defines a peripheral portion of the container 10 such that the side wall 24 includes an outer peripheral surface 28. The bottom wall 22 and the side wall 24 cooperate to define an internal storage compartment 26 for storage of a plurality of units of a product. In some instances, an upper portion 30 of the side wall 24 may define a lip 32 in such a manner that the upper portion 30 the side wall 24 has a reduced diameter (as compared to the diameter of the remainder of the outer surface of the side wall).

The cover 40 may be provided for enclosing the units of product within the internal storage compartment 26. In this regard, the cover 40 is typically removably secured to the body 20 by a snap-fit or an interference fit. As shown in FIG. 4, the cover 40 has a top wall 42 having an inner surface 43, which, in some instances, may be substantially planar, and a peripheral flange 44 depending from the top wall 42 which, in some instances, may be cylindrical. The peripheral flange 44 of the cover 40 is received over the side wall 24 of the body 20 so as to form an enclosure therebetween. In an alternative embodiment, protrusions, projections, or ribs (not shown) may interact with the outer peripheral surface 28 of the side wall 24 of the body 20.

The cover 40 will typically have the same approximate size or diameter as the side wall 24 of the body 20 such that the cover 40 and body 20 form a smooth exterior surface when the cover is placed over the of the lip 32 and fully seated upon the body. Hence, the container 10 may be compact and flat so as to be suitable for storage and transportation by a user.

Containers for smokeless tobacco products can also be fabricated from tobacco paper disclosed herein. The dimensions of smokeless tobacco container embodiments described herein can vary without departing from the disclosure. See, for example, the various sizes and types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 7,878,324 to Bellamah et al.; U.S. Pat. No. 7,946,450 to Gelardi et al.; U.S. Pat. No. 8,033,425 to Gelardi; U.S. Pat. No. 8,087,540 to Bailey et al.; U.S. Pat. No. 8,096,411 to Bailey et al.; U.S. Pat. No. D592,956 to Thiellier U.S. Pat. No. D594,154 to Patel et al.; and U.S. Pat. No. D625,178 to Bailey et al.; US Pat. Pub. Nos. 2009/0014343 to Clark et al.; 2009/0014450 to Bjorkholm; 2009/0230003 to Thiellier; 2010/0084424 to Gelardi; 2010/0133140 to Bailey et al; and 2011/0204074 to Gelardi et al., which are incorporated herein by reference. However, in preferred embodiments, the containers of the disclosure can be described as having a cylindrical size suitable for handheld manipulation and operation. Exemplary dimensions for such handheld cylindrical embodiments include diameters in the range of about 50 mm to about 100 mm, and more typically about 60 mm to about 80 mm. Exemplary wall thicknesses include the range of about 0.5 mm to about 1.5 mm, and more typically about 0.8 mm to about 1.4 mm. Exemplary depths for handheld container embodiments of the present disclosure range from about 5 mm to about 50 mm, more typically about 8 mm to about 30 mm, and most often about 15 mm to about 25 mm. An exemplary general outward appearance of the container is that used for commercially available GRIZZLY and KODIAK products that are marketed by American Snuff Company, LLC.

The containers of the present disclosure can be prepared by any known manufacturing process, such as the spiral bound manufacturing processes set forth in U.S. Pat. No. 5,556,365 to Drummond et al.; U.S. Pat. No. 5,829,669 to Drummond et al.; and U.S. Pat. No. 6,036,629 to Rea et al., each of which are herein incorporated by reference in their entirety. In a spiral bound process, a first innermost fiberboard or paperboard layer is wound onto a stationary mandrel while simultaneously winding one or more exterior fiberboard or paperboard plies successively radially outwardly from the exterior of the first ply. In one embodiment, the container can be manufactured in a manner to produce a single ply paperboard container according to the process forth in U.S. Pat. No. 5,586,963 to Lennon et al., which is incorporated herein by reference in its entirety. In another embodiment, the container can be manufactured in a manner to produce a multi-ply paperboard container according to the process as set forth in U.S. Pat. No. 6,558,306 to Lowry et al., which is incorporated herein by reference in its entirety.

Paper or cardstock materials alone are not well-suited to preserving the freshness of the contents of a container because those materials generally do not provide a sufficiently air-tight or air-impermeable barrier. In various packaging embodiments, a foil laminated paper can be used to retain moisture and prevent the packaged goods from drying out. The foil laminated paper can also prevent insect infestation. Paper coated with appropriate barrier coatings can be used in place of the foil lamination. For example, softpack and hardpack cigarette packages often employ inner or outer wraps of metal foil/paper laminates, metallized paper or plastic wrappers, or low permeability transparent polymeric sheet overwraps to protect the freshness and aroma of packaged cigarettes and other smoking article products. Therefore, in cigarette packaging, it is conventional to wrap the bundle of cigarettes of a package in a sheet material known as an "innerwrap" which almost always includes a layer of paper for strength, a layer of metal foil to inhibit loss of moisture content of the cigarettes, and an adhesive to bond the foil and paper into a single sheet or laminate. Accordingly, the layer of paper can be formed from tobacco-derived paper as described herein. The thus-wrapped cigarettes are then placed in a soft pack or a paperboard box, as the case may be, and overwrapped with a clear plastic sheet material, such as a polypropylene or polyethylene terephthalate film.

In various embodiments, tobacco paperboard can be used to fabricate a stiffer or harder container formed from fibrous pulp comprising about 5 to about 100 (e.g., about 75 to about 90) dry weight percent tobacco-based pulp. In an embodiment, the tobacco paperboard is formed from fibrous pulp comprising about 85 dry weight percent tobacco fibers. The remaining portion of the fibrous pulp can be wood based pulp, for example. Papermaking additives can be combined with the pulp such that the paperboard comprises about 80-95 dry weight percent fiber materials, the balance being papermaking additives known in the art. In some embodiments, paperboard basis weights range from about 50 to about 275 g/m$^2$, or about 175 to about 275 g/m$^2$. In some embodiments, caliper of a tobacco paperboard can range from about 0.003 inches to about 0.200 inches (i.e., about 3 mils to about 200 mils).

For example, in some embodiments, a solid bleached sulfate board, comprising bleached, chemically pulped tobacco stalk and a pigmented coating on both surfaces, can be used for cigarette packaging. The pulp can be produced from the kraft pulping process, for example. The pulp can be treated in various ways to prepare them for a paperboard machine. For example, the pulp can be refined to modify surface structure of the fibers. As discussed above, swelling in water can expand the surface area of the fibers and thereby improve strength of the final paper product. Additives such as alum and rosin sizing can be used to increase water repellency of the fibers and other agents can be used to increase the whiteness of the fibrous material, for example.

In various embodiments, more pliable paper or paperboard can be used to fabricate a softer, more flexible container formed from a fibrous pulp comprising about 5 to about 100 (e.g., about 75 to about 100) dry weight percent tobacco-based pulp. Papermaking additives can be combined with the pulp such that the paper or paperboard comprises about 80-95 dry weight percent fiber materials, the balance being papermaking additives known in the art. This pliable paper can also be used as labels and other packaging materials, for example. The basis weight of the pliable paper can range from about 10 to about 150 g/m$^2$ (e.g., about 10 to about 75 g/m$^2$ or about 60 to about 90 g/m$^2$, for example. In some embodiments, caliper of a pliable paper or paperboard can range from about 0.001 inches to about 0.200 inches (i.e., about 1 mils to about 200 mils). In some embodiments, caliper of pliable paper can range from about 1 mils to about 6 mils, for example.

In various embodiments, tobacco paper can be used as the paper substrate in a barrier layer. The tobacco paper used to fabricate barrier paper can be formed from fibrous pulp comprising about 5 to about 100 (e.g., about 75 to about 90) dry weight percent tobacco-based pulp. In an embodiment, the tobacco paperboard is formed from fibrous pulp comprising about 85 dry weight percent tobacco fibers. The remaining portion of the fibrous pulp can be wood based pulp, for example. Papermaking additives can be combined with the pulp such that the paper comprises about 80-95 dry weight percent fiber materials, the balance being papermaking additives known in the art. In some embodiments, barrier basis weights range from about 10 to about 150 g/m$^2$ (e.g., about 50 to about 150 g/m$^2$).

The following examples are provided to illustrate further the present invention, but should not be construed as limiting the scope thereof. Unless otherwise noted, all parts and percentages are by weight.

EXPERIMENTAL

The present invention is more fully illustrated by the following examples, which are set forth to illustrate the present invention and are not to be construed as limiting thereof. In the following examples, mm means millimeter. All weight percentages are expressed on a dry basis, meaning excluding water content, unless otherwise indicated.

Example 1

In the following non-limiting example, duplicate soda cooks are carried out on stalk and root samples. The results are quite similar for the duplicates, showing good repeatability. Both materials produce pulp with a Kappa number in the bleachable range. The unbleached pulp for both samples is made into board-weight handsheets and tested for strength properties.

Cooks are done in two types of 10-liter batch digesters: the "classic" M&K unit, as well as a similar unit designed and built by North Carolina State University (NCSU). Both types feature indirect electrical heating and liquor recirculation.

After cooking, the material is fiberized by passing it through a Bauer 8-inch disk refiner with a plate gap of 0.020 inches. For the second replicate on each material, a second pass is done at 0.005 inches. The fiberized material, now considered pulp, is passed through a slotted screen with 0.010 inches, to remove chives and unpulped material. The screened accepts are test for yield, Kappa number, brightness, fiber length distribution, and freeness.

Pulping data are shown in Table 1 below.

TABLE 1

| Pulping Results for Stalks and Roots Samples | | | | |
|---|---|---|---|---|
| Cook# | 1 | 2 | 3 | 4 |
| Tobacco Type | Burley | Burley | Burley | Burley |
| Raw Material Type | Stalk | Root | Stalk | Root |
| Digester | MK NCSU | MK | MK | MK |
| Pulping Data | | | | |
| NaOH, % on OD Material | 43 | 43 | 43 | 43 |
| Liquor to Fiber Ratio | 6:1 | 6:1 | 6:1 | 6:1 |
| Max Temp ° C. | 170 | 170 | 170 | 170 |
| Time to Temp, Minutes | 60 | 60 | 60 | 60 |

TABLE 1-continued

| Pulping Results for Stalks and Roots Samples | | | | |
|---|---|---|---|---|
| Cook# | 1 | 2 | 3 | 4 |
| H Factor | 2100 | 2100 | 2100 | 2100 |
| Black Liquor pH | 12.6 | 12.6 | 12.6 | 12.5 |
| REA Residual Alkali (gpl as Na2O) | 24.9 | 24.9 | 26.2 | 24.5 |
| % Alkali Consumed | 65.2 | 65.2 | 63.5 | 65.8 |
| Pulp Testing | | | | |
| Total Yield, % of OD Raw Material | 33.9 | 35.1 | 32.5 | 34.9 |
| % Rejects in Pulp | 0.0 | 0.0 | 0.0 | 0.0 |
| Screened Yield, % on OD Raw Material | 28.6 | 30.9 | 28.5 | 28.5 |
| Kappa Number | 12.9 | 8.9 | 14.2 | 8.2 |
| Freeness | 592 | 593 | 431 | 488 |
| ISO Brightness | 29.4 | 46.8 | 28.2 | 47.7 |
| Avg, Fiber Length, length-wtd, mm | 0.800 | 0.649 | 0.741 | 0.629 |
| Fiber width, microns | 25.5 | 23.5 | 26.2 | 24.3 |
| Fines, % by number | 16.86 | 14.82 | 30.52 | 30.42 |

For the stalk cooks, the cooks are well repeatable, even when two different types of batch digesters are used. It is noted that the yield and Kappa number can be affected by the quality of the raw material. In addition, the Kappa number for the root cooks is lower than the Kappa numbers for the stalks, indicating easier delignification. The screened yield is about the same for the stalk and root cooks. The fiber length is lower in the root-based pulp than in the stalk-based pulp, which is reasonable because stalk fibers are used for plant support while root fibers are used for storage.

Figure 5:
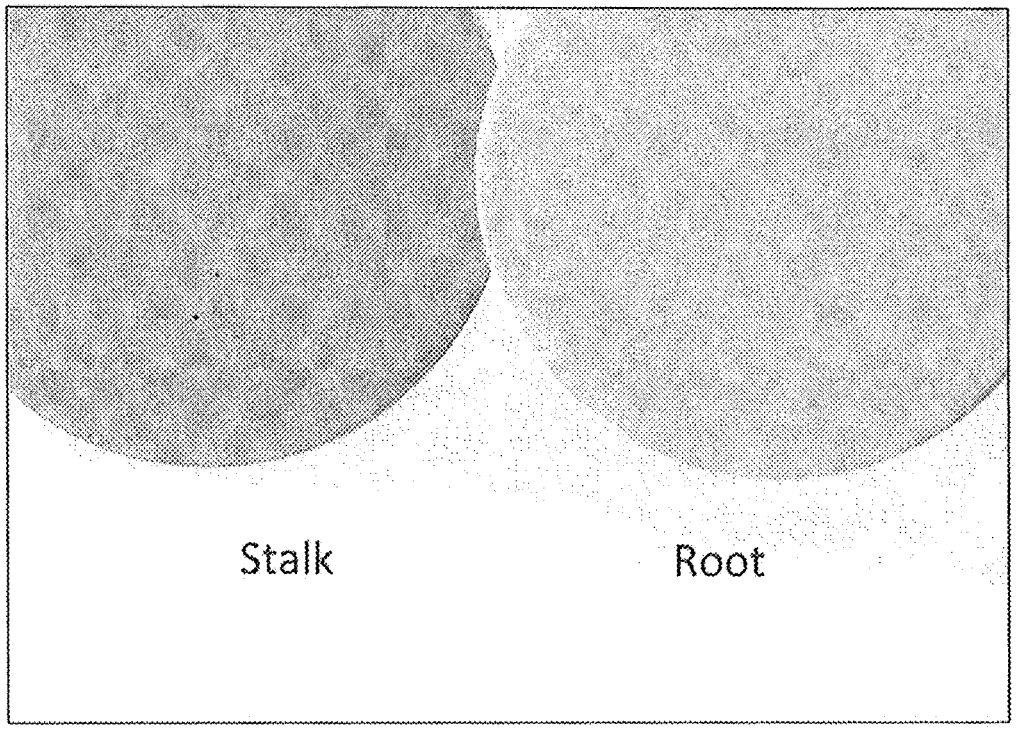
FIG. 5 is a top perspective view of pads made from unbleached stalk and root pulps.

For both cooks, the Kappa numbers can be considered to be in the bleachable range. It should be noted that in this example, the cooked mass for the second cook on each raw material is passed through the defiberizing refiner twice. The second plate gap is quite tight (0.005 inches). As a result, the pulp is somewhat refined, as shown by the lower freeness, decreased fiber length, increased fiber width, and increased fines. Therefore, this pulp is not used for sheet testing, but the results are still useful to look at the repeatability of the procedure and the uniformity of the raw material. Both pulps appear fairly light-colored, as compared to unbleached wood pulp. The stalk pulp is much brighter, which may be due to the significantly lower Kappa number. Both pulps are quite clean. The paperboard handsheets (also referred to as pads) made from each pulp are shown in FIG. 5.

Example 2

In the following non-limiting example, six soda cooks are carried out on stalk and root samples. Tobacco stalk and root pulps are made into board-weight handsheets for evaluation.

Two cooks (#5 and #6) are done in an M&K digester. A more practical 24% caustic charge is used, as well as a 160° *C. maximum* temperature and an H-factor of 1000. For the sixth cook (#6), the stalk is soaked overnight in excess distilled water, and the water is drained prior to pulping with the same conditions as for Cook #5. A second sample of stalk is soaked, drained, and then analyzed for yield loss during soaking. For Cook #6, the alkali charge is based on the original starting weight of material, instead of adjusting for the yield loss during soaking.

Pulping data are shown in Table 2 below.

TABLE 2

Pulping Results for Stalks and Roots Samples

| Cook# | 1 | 2 | 3 | 4 | 5 | 6 |
|---|---|---|---|---|---|---|
| Tobacco Type | Burley | Burley | Burley | Burley | Burley | Burley |
| Raw Material Type | Stalk | Root | Stalk | Root | Stalk | Stalk |
| Digester | MK NCSU | MK | MK | MK | MK | MK |
| Pulping Data | | | | | | |
| Pretreatment | — | — | — | — | — | Pre-soak |
| NaOH, % on OD Material | 43 | 43 | 43 | 43 | 24 | 24 |
| Liquor to Fiber Ratio | 6:1 | 6:1 | 6:1 | 6:1 | 6:1 | 6:1 |
| Max Temp ° C. | 170 | 170 | 170 | 170 | 160 | 160 |
| Time to Temp, Minutes | 60 | 60 | 60 | 60 | 60 | 60 |
| H Factor | 2100 | 2100 | 2100 | 2100 | 1000 | 1000 |
| Black Liquor pH | 12.6 | 12.6 | 12.6 | 12.5 | 11.9 | 12.3 |
| REA Residual Alkali (gpl as Na2O) | 24.9 | 24.9 | 26.2 | 24.5 | 3.8 | 10.5 |
| % Alkali Consumed | 65.2 | 65.2 | 63.5 | 65.8 | 90.1 | 72.6 |
| Pulp Testing | | | | | | |
| Total Yield, % of OD Raw Material | 33.9 | 35.1 | 32.5 | 34.9 | 44.0 | 38.7 |
| % Rejects in Pulp | 0.0 | 0.0 | 0.0 | 0.0 | 9.7 | 0.15 |
| Screened Yield, % on OD Raw Material | 28.6 | 30.9 | 28.5 | 28.5 | 29.4 | 35.0 |
| Kappa Number | 12.9 | 8.9 | 14.2 | 8.2 | 45.9 | 33.4 |
| Freeness | 592 | 593 | 431 | 488 | 633 | 608 |
| ISO Brightness | 29.4 | 46.8 | 28.2 | 47.7 | | 30.4 |
| Avg, Fiber Length, length-wtd, mm | 0.800 | 0.649 | 0.741 | 0.629 | 0.866 | 0.769 |
| Fiber width, microns | 25.5 | 23.5 | 26.2 | 24.3 | 28.4 | 27.7 |
| Fines, % by number | 16.86 | 14.82 | 30.52 | 30.42 | 28.68 | 26.79 |
| PFI Refining on Brownstock | | | | | | |
| Freeness, CSF, at 500 revs | 433 | | | | | |
| 1000 revs | 366 | 569 | | | | |
| 2000 revs | | 469 | | | | |
| 3000 revs | 392 | 418 | | | | |
| 4000 revs | | | | | | |
| 5000 revs | | | | | | |
| 6000 revs | 291 | 393 | | | | |

The stiffness measurements of the stalk and root pulps are comparable to (and perhaps slightly higher than) a wood-based sheet. The folding endurance, however, is unexpectedly 15-40 times higher. Bursting strength testing does not show that bonding strength is unusually high for the stalk and root sheets. For the Cook #5 done on the stalk, using a more practical caustic charge of 24%, the resulting Kappa is 45.9, which can still be considered bleachable. For Cook #5, the lower alkali charge and H-factor results in a higher Kappa number (45.9) and screened rejects (9.7%) than for Cooks 1 and 3. When the stalk is soaked overnight in distilled water and drained, and the cook is repeated (Cook #6), the Kappa number falls to 33.4, and rejects decrease considerably. In order to determine the amount of material lost during soaking, a second sample of chips is soaked, drained, and then oven dried. It is determined in this manner that there is a 12.7% yield loss during soaking. Since the yield loss during soaking is not taken into account, the "true" alkali charge on OD material for Cook #6 is about 27%. As shown above in Table 2, for Cook #6, the Kappa number decreased by 13 points, while the screened yield increased by 5%. Therefore, it is concluded that there is a significant amount of easily-removed extraneous material in the stalk that consumes alkali, but does not contribute to useful fiber yield.

Portions of the stalk and root pulps from Cooks #1 and #2 are refined in a standard laboratory PFI mill, to decreasing freeness levels. The refined pulps are formed into standard British handsheets according to TAPPI standards, with a target basis weight of 233 g/m$^2$. The sheets are then tested for Taber stiffness (T489), MIT double fold (T511) and bursting strength (T403). The PFI refining and handsheet testing results for Cooks #1 and #2 are shown below in Table 3.

TABLE 3

Results of PFI Refining and Handsheet Testing for Unbleached Pulps

| | Standard | Cook #1 Stalk, Kappa = 12.9 | | | | | Cook #2 Root, Kappa = 8.9 | | | | |
|---|---|---|---|---|---|---|---|---|---|---|---|
| PFI Revs | — | 500 | 1000 | 2000 | 3000 | 6000 | 500 | 1000 | 2000 | 3000 | 6000 |
| Freeness CSF | — | 433 | 366 | | 392 | 291 | | 569 | 469 | 418 | 393 |
| Basis Weight (g/m$^2$) | 236 | 235 | 258 | | 235 | 233 | 248 | 245 | 254 | 257 | 246 |
| Caliper (mils) | 12 | 11.7 | 11.8 | | 10.0 | 10.5 | 12.1 | | 13.2 | 12.2 | 11.3 |

TABLE 3-continued

| Results of PFI Refining and Handsheet Testing for Unbleached Pulps | | | | | | | | | |
|---|---|---|---|---|---|---|---|---|---|
| | Standard | Cook #1 Stalk, Kappa = 12.9 | | | | Cook #2 Root, Kappa = 8.9 | | | |
| Apparent Density (g/cm$^3$) | 0.774 | 0.791 | 0.861 | 0.923 | 0.871 | 0.807 | 0.756 | 0.828 | 0.855 |
| Taber Stiffness Units | 57 (avg) | 67.6 | 84.0 | 53.2 | 49.3 | 61.3 | 68.2 | 65.8 | 57.2 |
| MIT double-folds, 0.5 kg | 520 | 19979 | | | 12833 | 18179 | | | 7568 |
| Burst Index (kPa*m$^2$/g) | — | 3.6 | 3.7 | | 4.5 | | 3.4 | 3.2 | 3.4 | 3.7 |

Basis weight and caliper values for the sheets are similar to the wood-based standard values. Stiffness values for the directionless handsheets are somewhat higher for both stalk and root than for the machine direction (MD) and cross direction (CD) average of the machine-made standard sheet. The values obtained for the folding endurance are 15-40 times higher than for the standard. The standard sheet is tested and broke at the 500 value indicated by the specifications.

It is well known that, for some nonwood fibers with thin and easily-collapsed cell walls, the bonding strength, as measured by tensile or burst in handsheets, can actually be higher than for thick-walled, longer fibers such as softwoods. The reason is that the collapsed fibers are better able to form a hyper-bonded network, which leads to a high tensile and bursting strength. Typically, however, tearing strength and folding endurance are much lower. To see if superior fiber bonding is responsible for the high folding endurance values obtained for the tobacco pulps, bursting strength is measured for some of the sheets. As can be seen in Table 3 above, the bursting index results range between 3.6 and 4.5. This is the same range noted in the literature for softwood linerboard and also for bamboo linerboard. Therefore, hyper-bonding alone does not seem to be the cause of the high folding values for tobacco pulps.

In summary, both tobacco stalk and root materials, even when over-cooked, produce unbleached pulps with mechanical properties similar to those specified for a wood-based solid bleached sulfate standard sample.

Example 3

In this non-limiting example, two small cooks are done on tobacco stalk using two different alkali charges. Cooks #7 and #8, both done on Burley stalk, are identical except that Cook #8 uses an alkali charge 4% lower (on OD) than Cook #7. Pulping data are shown in Table 4 below.

TABLE 4

| Pulping Results for Stalk Samples | | |
|---|---|---|
| Cook# | 7 | 8 |
| Tobacco Type | Burley | Burley |
| Raw Material Type | Stalk | Stalk |
| Digester | MK | MK |
| Pulping Data | | |
| Pretreatment | — | — |
| NaOH, % on OD Material | 27 | 23 |

TABLE 4-continued

| Pulping Results for Stalk Samples | | |
|---|---|---|
| Cook# | 7 | 8 |
| Liquor to Fiber Ratio | 6:1 | 6:1 |
| Max Temp ° C. | 160 | 160 |
| Time to Temp, Minutes | 60 | 60 |
| H Factor | 1000 | 1000 |
| Black Liquor pH | 12.1 | 13.1 |
| REA Residual Alkali (gpl as Na2O) | 3.9 | 6.0 |
| % Alkali Consumed | 91.3 | 84.3 |
| Pulp Testing | | |
| Total Yield, % of OD Raw Material | 43.9 | 37.6 |
| % Rejects in Pulp | 1.2 | 4.0 |
| Screened Yield, % on OD Raw Material | 35.2 | 24.4 |
| Kappa Number | 37.5 | 53.2 |
| Freeness | 594 | 602 |
| ISO Brightness | 22.7 | 19.2 |
| Avg, Fiber Length, length-wtd, mm | 0.777 | 0.882 |
| Fiber width, microns | 27.8 | 28.6 |
| Fines, % by number | 24.62 | 20.60 |
| PFI Refining on Brownstock | | |
| Freeness, CSF, at 500 revs | 531 | 582 |
| 1000 revs | 444 | 495 |
| 2000 revs | | |
| 3000 revs | 321 | 334 |
| 4000 revs | | |
| 5000 revs | | |
| 6000 revs | 185 | 208 |

Portions of each unbleached pulp are refined in a standard laboratory PFI mill, to decreasing freeness levels. The refined pulps are formed into standard British handsheets according to TAPPI standards, with a target basis weight of 60 g/m$^2$. The sheets are then tested for the following properties: Taber stiffness (T489); tensile strength (T494); tearing resistance/strength (T414); Scott internal bond (T833); Parker roughness, using soft backing and 20 kPa (T555); and Cobb water absorption (T441). Handsheet testing data are shown in Table 5 below.

TABLE 5

Results of PFI Refining and 60 g/m$^2$ Handsheet Testing for Unbleached Pulps

| | Cook #7 Stalk, Kappa = 37.5 | | | | Cook #8 Stalk, Kappa = 53.2 | | | |
|---|---|---|---|---|---|---|---|---|
| PFI revs | 500 | 1000 | 3000 | 6000 | 500 | 1000 | 3000 | 6000 |
| Freeness, CSF | 531 | 444 | 321 | 185 | 582 | 495 | 334 | 208 |
| Basis Weight, g/m2 | 66.3 | 65.8 | 65.9 | 64.3 | 64.6 | 66.5 | 66.0 | 65.4 |
| Caliper, mils | 4.27 | 3.98 | 3.56 | 2.99 | 4.45 | 3.83 | 3.35 | 3.29 |
| Apparent Density, g/cm3 | 0.611 | 0.650 | 0.729 | 0.846 | 0.571 | 0.684 | 0.775 | 0.782 |
| Parker Roughness, 20, soft, microns | 5.70 | 6.10 | 6.82 | 7.52 | 6.59 | 7.59 | 7.55 | 7.53 |
| Tensile Index, Nm/g | 54.3 | 59.8 | 62.4 | 66.8 | 42.8 | 55.6 | 63.3 | 62.2 |
| Tensile Energy Absorption, J/g | 0.648 | 0.893 | 0.940 | 0.838 | 0.429 | 0.569 | 0.761 | 0.611 |
| Tear Index, mN*m2/g | 5.52 | 5.49 | 5.67 | 4.77 | 4.68 | 4.35 | 5.01 | 4.62 |
| Taber Stiffness Units | 1.4 | 1.2 | 1.0 | 0.7 | 1.3 | 1.0 | 0.8 | 0.8 |
| Scott Internal Bond (normalized), Nm/g | 1.44 | 1.86 | 3.58 | 5.39 | 1.20 | 2.62 | 4.89 | 5.54 |
| Cobb Water Absorption, g/m2 | 150 | 140 | 120 | 80 | 150 | 130 | 110 | 100 |
| MIT Double Folds, 0.5 kg loading | 3547 | | | 15216 | | | | |
| MIT Double Folds, 1 kg loading | 2086 | | | 4669 | | | | |

Figure 6:
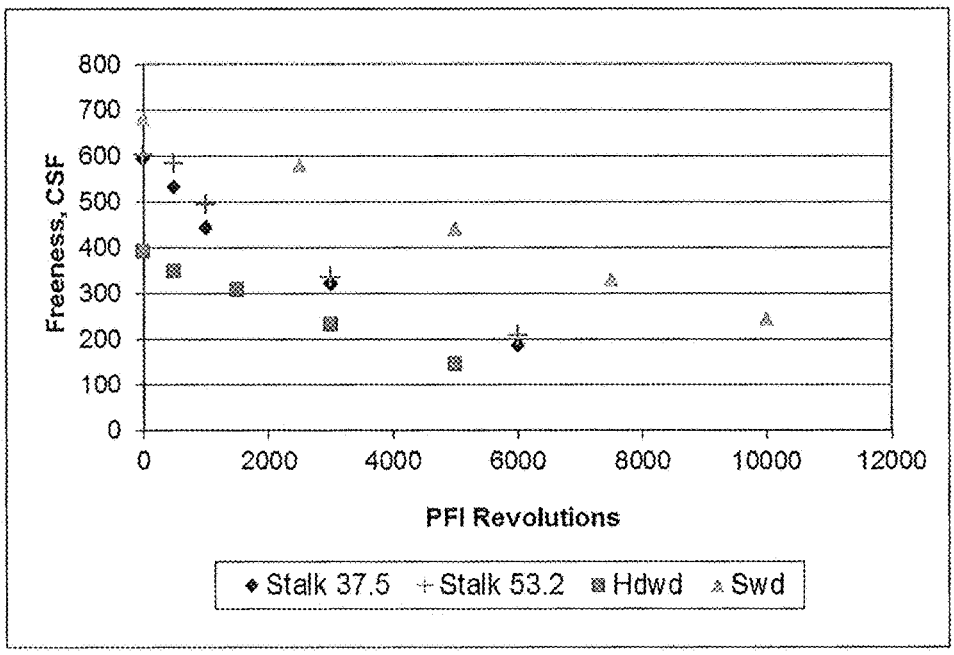
FIG. 6 is a plot of freeness versus PFI revolutions for both tobacco stalk pulps and wood pulp references.
Figure 7:
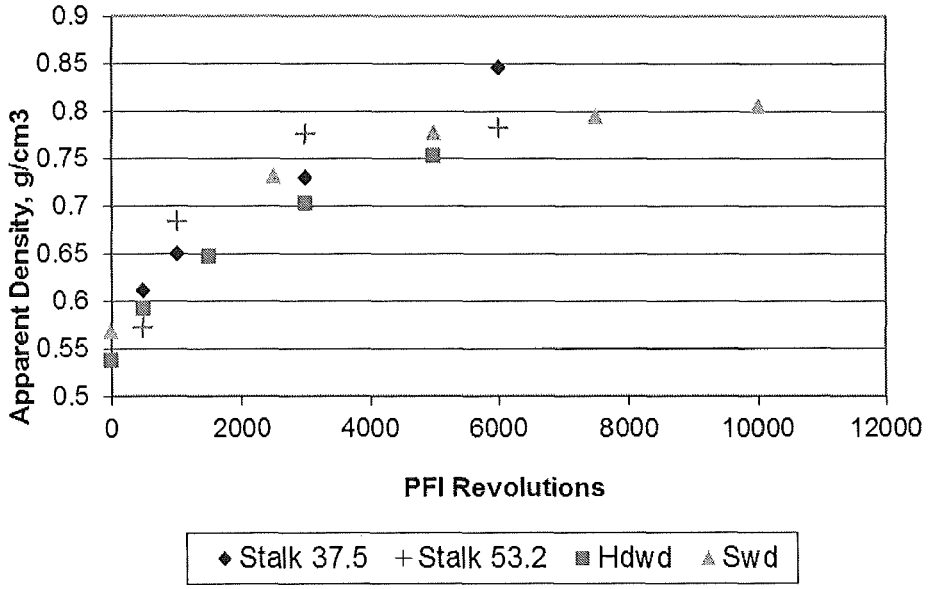
FIG. 7 is a plot of handsheet apparent density (g/cm$^3$) versus PFI revolutions for both tobacco stalk pulps and wood pulp references.

The handsheet properties are best analyzed by plotting them versus freeness and comparing them to tabulated data. For this comparison, data for two bleached wood pulps are chosen—*eucalyptus* hardwood and northern softwood (NIST standard data). Both reference pulps are from kraft cooks, with chlorine-dioxide-based bleaching. FIG. 6 shows the "refining curve," a plot of freeness (CSF) versus PFI revolutions for both tobacco stalk pulps, along with the wood pulp reference pulps. As expected, both tobacco stalk pulps refine easier than softwood, but they are a bit harder to refine compared to *eucalyptus*. As shown in FIG. 7, both stalk pulps have handsheet densities similar to hardwood and softwood pulp.

Figure 8:
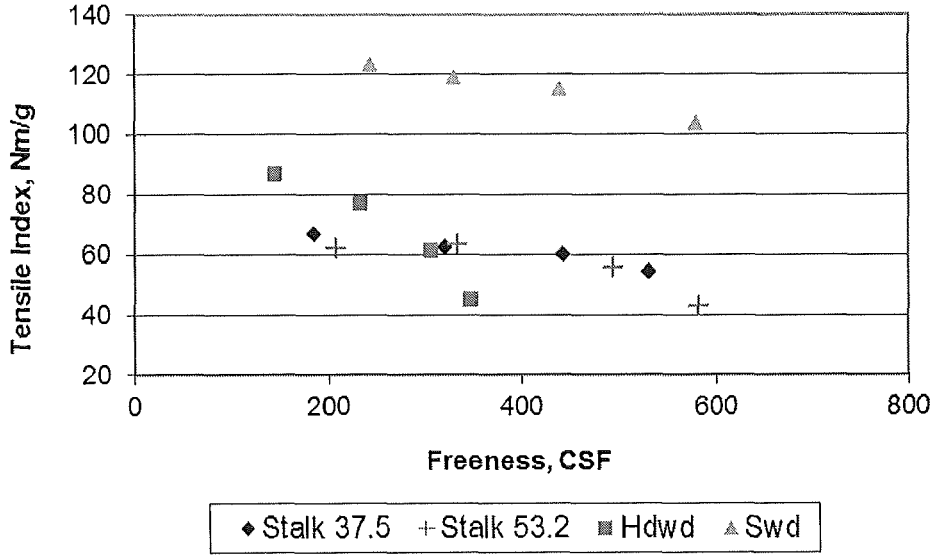
FIG. 8 is a plot of the tensile index versus refined freeness for both tobacco stalk pulps and wood pulp references.

In FIG. 8, the tensile index (tensile strength normalized by dividing it by the sheet basis weight) is plotted versus freeness. As expected, the tobacco pulps have a much lower tensile strength compared to softwood (fiber length and wall thickness play a key role in bonding strength), but they are similar in nature to *eucalyptus*. Typical values for paper in the literature range from 20-70 Nm/g.

Figure 9:
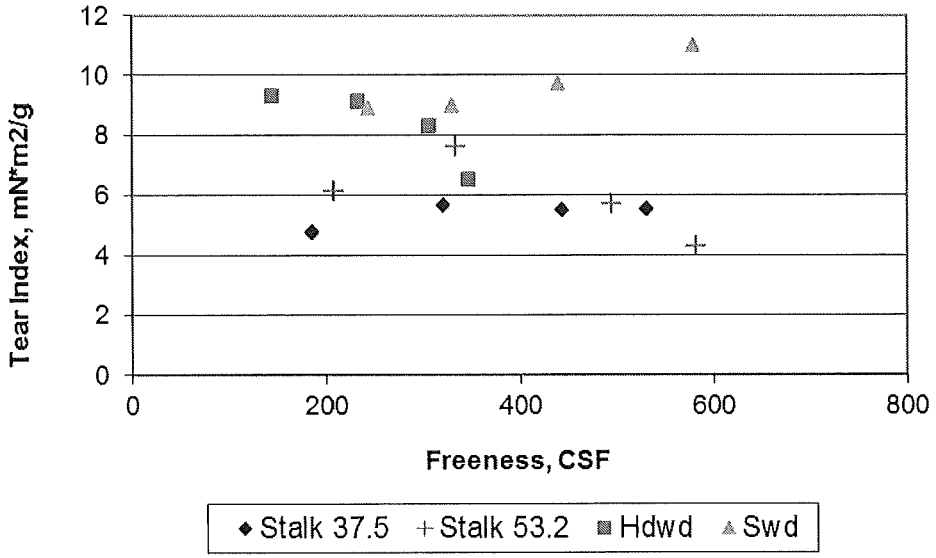
FIG. 9 is a plot of the tearing strength versus refined freeness for both tobacco stalk pulps and wood pulp references.

As shown in FIG. 9, the tearing strength for both tobacco pulps does not change much over the range of refining freeness values. While inferior to softwood, the values for tobacco are only moderately lower than those for *eucalyptus*. Typical values for wood-based paper in the literature range from 6-7, moderately higher than those measured for the tobacco pulps.

Figure 10:
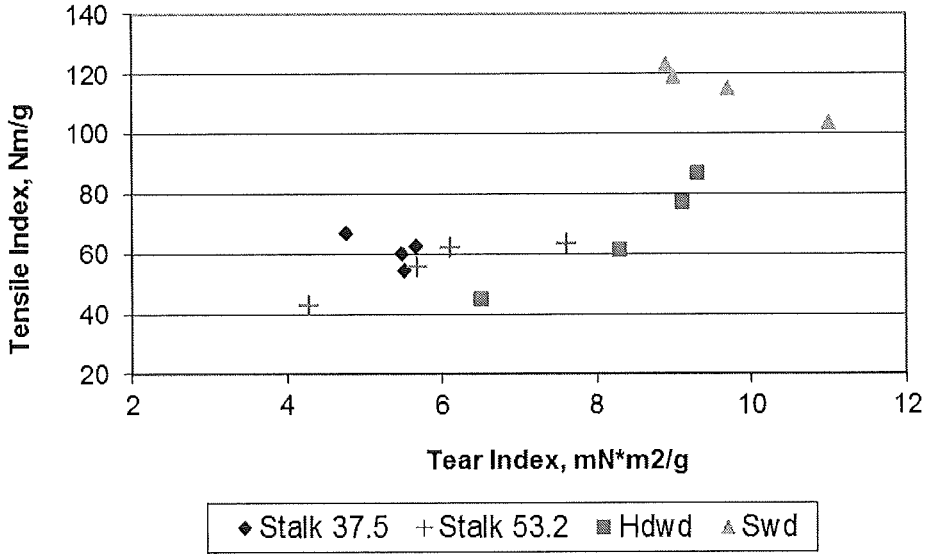
FIG. 10 is a plot of tensile strength (index) versus tearing strength (index) for both tobacco stalk pulps and wood pulp references.

FIG. 10 is a plot of tensile strength (index) versus tearing strength (index). While both tobacco pulps are mechanically inferior compared to softwood, the data indicate that the tobacco pulps are as good as, and possibly better than, *eucalyptus*.

Figure 11:
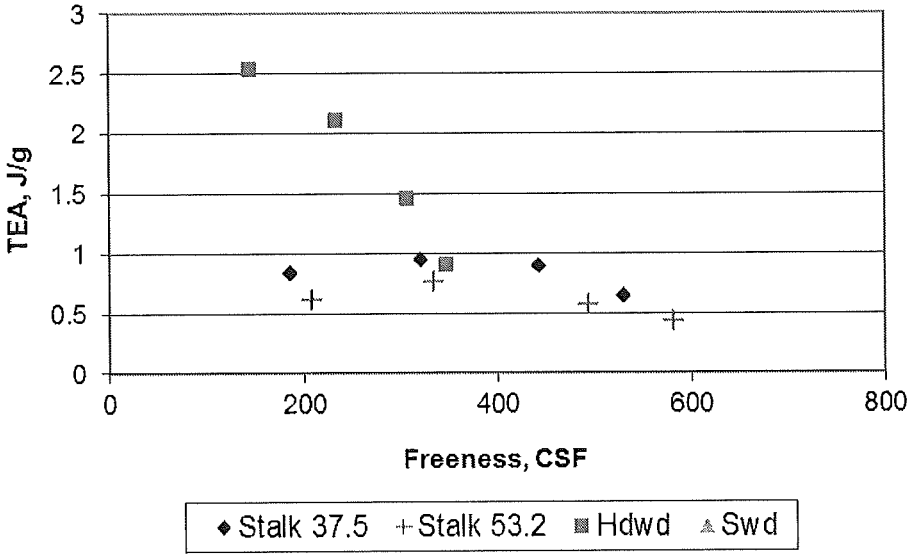
FIG. 11 is a plot of tensile energy absorption (TEA) versus refined freeness for both tobacco stalk pulps and wood pulp references.

As can be seen in FIG. 11, the Tensile Energy Absorption (TEA) values obtained for the tobacco pulps are comparable to lightly-refined *eucalyptus*, but inferior at lower freeness levels. No reference data are available for softwood. This result tends to indicate that the tobacco sheets, while having appreciable tensile strength, are somewhat brittle and not stretchy.

Figure 12:
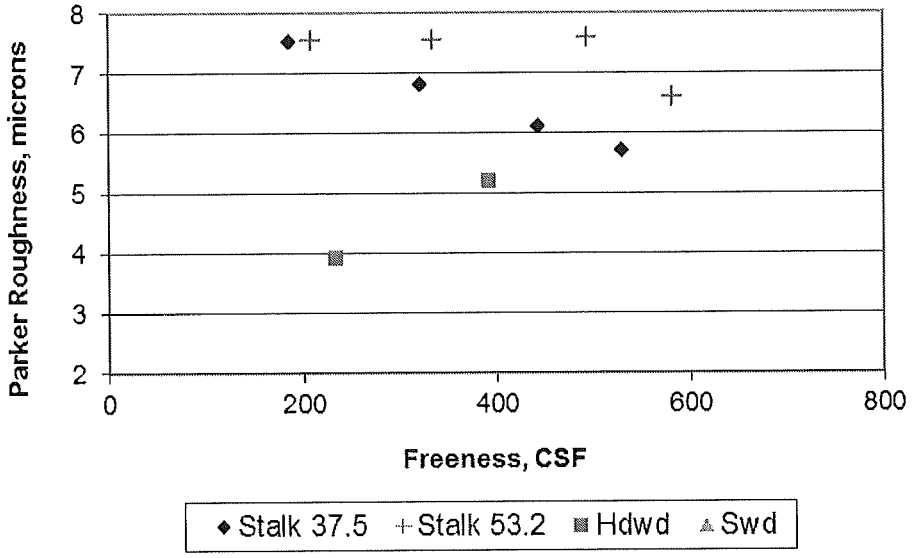
FIG. 12 is a plot of Parker roughness values versus refined freeness for both tobacco stalk pulps and wood pulp references.

FIG. 12 shows a plot of Parker roughness values versus freeness (higher values mean lower smoothness). The values obtained for the tobacco pulps are unusual in that they increase with increased refining and smoothness normally increases with refining. While the values are higher than those for *eucalyptus* at lower freeness levels (higher refining), they are well within the range of values noted in the literature for hardwood handsheets made from PFI-refined pulp (5.5-6.8).

There is no plot for Taber Stiffness values because no reference data are available. However, the values obtained for the tobacco pulps are within the range of 0.7-3, as noted in the literature. Similarly, there is no plot for Cobb water absorption values. It should be noted that the Cobb test is intended for sized papers (sizing is a chemical treatment to make paper less absorbent). However, the tobacco sheets are not sized. As expected, the values are high because of the lack of sizing. Typical values for sized paper grades in the literature range from 20-30 g/m$^2$.

A folding endurance test is also performed on the handsheets. The results are relatively high. Sheets from Cook #7 are tested using both 0.5 kg and 1 kg loading. The results are well above 2000 double folds, a level normally associated with currency papers.

In summary, there are some modest differences in sheet properties for the two tobacco pulps produced at two different Kappa numbers, but in general the sheets made from the pulps are similar. In addition, with the exception of a moderately lower tearing strength and excessively high folding endurance, the sheet properties for the tobacco pulps are similar to, and sometimes better than, those noted for an *eucalyptus* hardwood reference pulp. The test values obtained are within the range of values found in the literature for hardwood pulps.

Example 4

In the following non-limiting example, tobacco root material is cooked at pilot scale and formed into paper.

First pilot cooks are completed. Samples of the pulps show a significant content of poorly-fiberized materials (called "rejects" or "shives" in the paper industry). To remove these materials, the pulp slurry is fed to an Ahlstrom M-200 Centrisorter pressure screen equipped with slots of 0.010 inches. Good fibers passing through the screen are directed to a separate tank, while the rejected materials (a mixture of rejects and good fiber) are fed back into the feed tank. In addition, a Gauld Periflow screen with a slotted basket with slots of 0.0006 inches is used to rescreen the slurry. In the event a large amount of sand/grit remains in the pulp slurry, a Beloit Posi-Flow centrifugal cleaner can be used to remove the contaminates.

Once the slurry is acceptable, the slurry is pumped across a slanting screen (hydrasieve) to remove excess water. Most fibers cannot achieve optimum strength for papermaking without refining, a mechanical process which flattens them and increases their surface area for bonding. Therefore, the dewatered slurry is passed through a Sprout-Bauer 12-inch disk refiner equipped with a 150 hp motor. The refiner plate gap is reduced to increase motor loading 12 kW above no-load.

Softwood market pulp is repulped and then refined at 0.85% consistency using two passes through the Sprout-Bauer refiner. For the first pass, the refiner is loaded to 55 kW, 10 kW higher than the no-load value of 45 kW. The flow rate is approximately 100 grams/minute. For the second pass, the refiner is loaded to 60 kW above the no-load value of 50 kW. The refined softwood fiber is added to the tobacco pulp slurry. The resulting refined softwood slurry represents 15% by weight of the total furnish. The consistency of the slurry, after softwood addition, is 1.4%.

The papermaking process is somewhat difficult for this slurry. Using the material that includes the 15% refined softwood pulp, a heavy sheet of about 188 g/m$^2$ is fabricated. Alternative basis weights of paper can be fabricated. There is some tendency for the sheet to stick to the press rolls, predominantly on the felt side (first press, bottom felted). Therefore, the first press is by-passed. The sheet runs fine through a second press, which is a reverse-fed press (i.e., the wire side of the sheet is contacted with the press roll). This behavior indicates the non-uniform distribution of fine/sticky materials in the wet end, which is not unusual for nonwood pulp grades. In addition, the dryer section shows that tobacco-based pulp is difficult to dewater and dry. Therefore, different levels of wood-based pulp can be added to the tobacco pulp to improve papermaking characteristics. Alternatively, machines with features to accommodate a weak sheet (e.g., no open draws, pickup felts, etc.) can be used to form paper from 100% tobacco root fiber pulp.

Example 5

In the following non-limiting example, soda cooks are carried out on root samples to a produce a pulp with a Kappa number in the bleachable range (i.e., a Kappa value of about 20). The pulp is formed into standard British handsheets according to TAPPI standards, with a target basis weight of 175 to about 275 g/m$^2$. The refined fibrous pulp comprises about 85 dry weight percent tobacco root fibers. No other additives are added to the handsheets.

Figure 13:
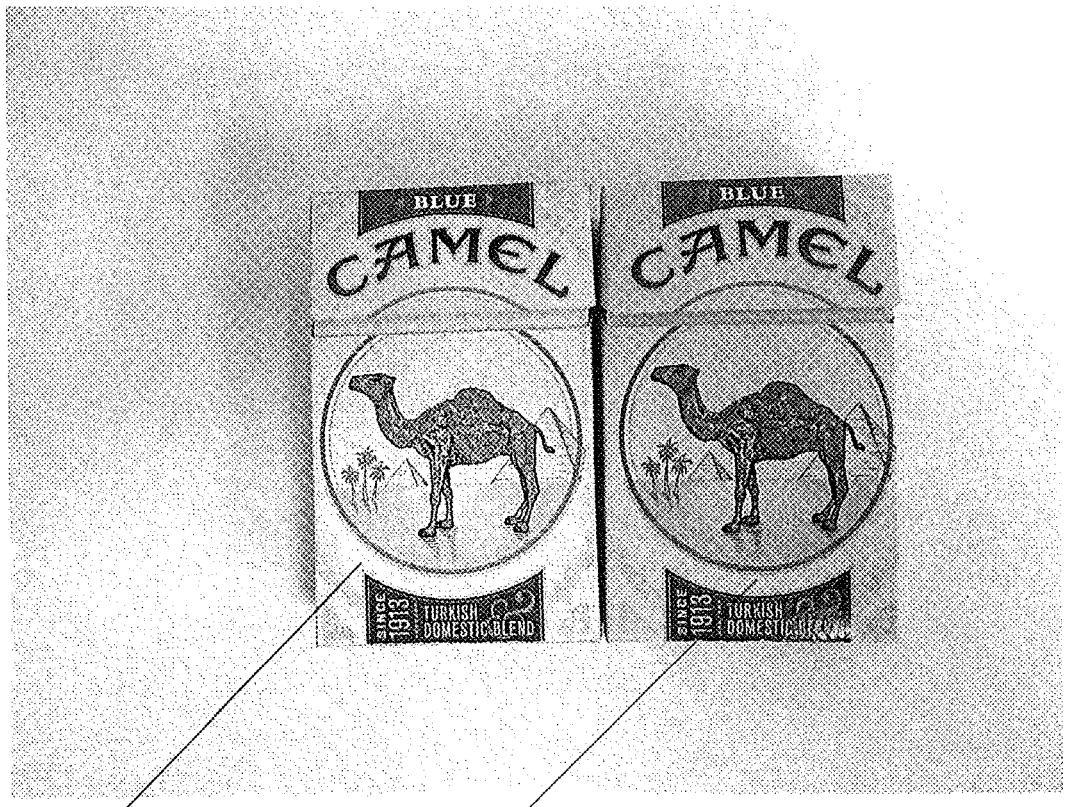
FIG. 13 is photographs of cartons constructed from tobacco-derived handsheets.

The handsheets are capable of forming a hard carton package for cigarettes. As illustrated in FIG. 13, cartons 305 fabricated from the tobacco-derived handsheets without lacquer can be printed on. FIG. 13 further illustrates that the cartons 300 fabricated from tobacco-derived handsheets with lacquer can be printed on. The graphics quality is acceptable, even with this non-refined pulp. Accordingly, the cartons fabricated from tobacco-derived paper perform as desired for commercial use.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A paper material comprising:

a fibrous material comprising at least 5 dry weight percent of fibers derived from a plant of the *Nicotiana* species;

wherein the paper material has a basis weight ranging from about 5 g/m$^2$ to about 450 g/m$^2$; and wherein the paper material has a caliper ranging from about 0.01 mils to about 200 mils;

wherein the paper material has a tearing index ranging from about 4.0 mN*m$^2$/g to about 6.5 mN*m$^2$/g.

2. The paper material of claim 1, wherein the fibrous material comprises at least 50 dry weight percent of fibers derived from a plant of the *Nicotiana* species.

3. The paper material of claim 1, wherein the paper material has a tensile index ranging from about 35 Nm/g to about 70 Nm/g.

4. The paper material of claim 1, wherein the paper material has a Tensile Energy Adsorption ranging from about 0.1 J/g to about 1.0 J/g.

5. The paper material of claim 1, wherein the paper material has a bursting index ranging from about 3.0 kPa*m$^2$/g to about 5.0 kPa*m$^2$/g.

6. The paper material of claim 1, wherein the paper material has a Scott internal bond ranging from about 1.0 to about 6.0.

7. The paper material of claim 1, wherein the paper material has a bending resistance ranging from about 0.1 Tabor Stiffness units to about 2.0 Tabor Stiffness units.

8. The paper material of claim 1, wherein the paper material has a bending resistance ranging from about 55 Tabor Stiffness units to about 90 Tabor Stiffness units.

9. The paper material of claim 1, wherein the paper material has a folding endurance ranging from about 3000 to about 20,000 MIT double folds at 0.5 kg loading.

10. The paper material of claim 1, wherein the paper material has a folding endurance ranging from about 2000 to about 5000 MIT double folds at 1.0 kg loading.

11. The paper material of claim 1, wherein the paper material has a Parker roughness value ranging from about 5.0 to about 8.0.

12. The paper material of claim 1, wherein the paper material has a Cobb value ranging from about 50 g/m$^2$ to about 200 g/m$^2$.

13. The paper material of claim 1, wherein the basis weight ranges from about 10 g/m$^2$ to about 150 g/m$^2$ and the caliper ranges from about 0.1 mils to about 6.0 mils; and wherein the paper material is suitable for use in a smoking article in the form of at least one of a tipping material, a plug wrap and a wrapping material.

14. The paper material of claim 13, wherein the paper material comprises about 55-70 dry weight percent of the fibrous material, and wherein the fibrous material comprises about 40-60 dry weight percent of fibers derived from a plant of the *Nicotiana* species.

15. The paper material of claim 13, wherein the paper material comprises about 55-90 dry weight percent of the fibrous material, and wherein the fibrous material comprises about 40-60 dry weight percent of fibers derived from a plant of the *Nicotiana* species.

16. The paper material of claim 13, wherein the paper material comprises about 55-70 dry weight percent of the fibrous material, and wherein the fibrous material comprises about 5-20 dry weight percent of fibers derived from a plant of the *Nicotiana* species.

17. The paper material of claim 1, wherein the basis weight ranges from about 10 g/m$^2$ to about 150 g/m$^2$ and the caliper ranges from about 1.0 mils to about 200 mils; and wherein the paper material is suitable for use in at least one of a soft carton container suitable to house smoking articles, a label, and a paper substrate of a barrier layer.

18. The paper material of claim 17, wherein the paper material comprises about 80-95 dry weight percent of the fibrous material, and wherein the fibrous material comprises about 75-100 dry weight percent of fibers derived from a plant of the *Nicotiana* species.

19. The paper material of claim 1, wherein the basis weight ranges from about 50 g/m$^2$ to about 275 g/m$^2$ and the caliper ranges from about 3.0 mils to about 200 mils; and wherein the paper material is suitable for use in a at least one of a hard carton suitable to house smoking articles and a container suitable to house smokeless tobacco products.

20. The paper material of claim 19, wherein the paper material comprises about 80-95 dry weight percent of the fibrous material, and wherein the fibrous material comprises about 75-90 dry weight percent of fibers derived from a plant of the *Nicotiana* species.

21. A container, comprising:

a body having a bottom wall and a side wall, the bottom wall and the side wall defining an internal storage compartment adapted for storage of a product;

and a top configured to be engaged with the body, wherein at least one of the bottom wall, side wall, and top comprises the paper material of claim 1;

wherein the paper material has a basis weight ranging from about 10 g/m$^2$ to about 350 g/m$^2$; and wherein the paper material has a caliper ranging from about 1.0 mils to about 200 mils.

22. The container of claim 21 further comprising a barrier material suitable to prevent moisture from reaching contents of the container, wherein the barrier material comprises a paper substrate comprising about 85-90 dry weight percent of a second fibrous material, and wherein the second fibrous material comprises about 5-100 dry weight percent of fibers derived from a plant of the *Nicotiana* species.

23. The container of claim 21, further comprising a wrapping material extending about a perimeter of the container.

24. The container of claim 21, wherein the internal storage compartment contains a plurality of products selected from the group consisting of cigarettes, smokeless tobacco products, and food products.

25. The container of claim 21, wherein the top is removable from the body.

26. The container of claim 21, wherein the top is engaged with the body.

27. The container of claim 21, wherein the container is a smokeless tobacco container or a cigarette pack.

28. The container of claim 21, wherein the top and body are generally cylindrical.

29. A method of producing a fibrous material comprising:

combining a tobacco input from a plant of the *Nicotiana* species with a strong base;

heating the combined tobacco input and strong base to form a tobacco pulp;

forming at least one layer of tobacco pulp;

drying the at least one layer of tobacco pulp;

pressing the at least one layer of tobacco pulp to form a paper material comprising a fibrous material comprising at least 5 dry weight percent of fibers derived from a plant of the *Nicotiana* species;

wherein the paper material has a basis weight ranging from about 5 g/m$^2$ to about 450 g/m$^2$;

wherein the paper material has a caliper ranging from about 0.01 mils to about 200 mils;

wherein the paper material has at least one of a tearing index ranging from about 4.0 mN*m$^2$/g to about 6.5 mN*m$^2$/g, a tensile index ranging from about 35 Nm/g to about 70 Nm/g, and a Tensile Energy Adsorption ranging from about 0.1 J/g to about 1.0 J/g; and constructing at least one of a smoking article and a container that comprises the paper material.

30. The method of claim 29, wherein the strong base is selected from the group consisting of sodium hydroxide, potassium hydroxide, sodium carbonate, sodium bicarbonate, potassium carbonate, potassium bicarbonate, ammonium hydroxide, ammonium bicarbonate, ammonium carbonate, and combinations thereof.

31. The method of claim 29, wherein the tobacco pulp is exposed to a bleaching agent.

32. The method of claim 29, wherein the layer of tobacco pulp is dried to at least 10% moisture content or less.

33. The method of claim 29, wherein a plurality of layers are pressed into a single paper product.

34. The method of claim 29, wherein a binder solution is applied to a surface of the layer of tobacco pulp to improve binding properties of the fibrous material.

35. A paper material comprising:

a fibrous material comprising at least 5 dry weight percent of fibers derived from a plant of the *Nicotiana* species;

wherein the paper material has a basis weight ranging from about 5 g/m$^2$ to about 450 g/m$^2$;

wherein the paper material has a caliper ranging from about 0.01 mils to about 200 mils; and wherein the paper material has at least one of a tensile index ranging from about 35 Nm/g to about 70 Nm/g, a Tensile Energy Adsorption ranging from about 0.1 J/g to about 1.0 J/g, and a bursting index ranging from about 3.0 kPa*m$^2$/g to about 5.0 kPa*m$^2$/g.

36. The paper material of claim 35, wherein the basis weight ranges from about 10 g/m$^2$ to about 150 g/m$^2$ and the caliper ranges from about 1.0 mils to about 200 mils; and wherein the paper material is suitable for use in at least one of a soft carton container suitable to house smoking articles, a label, and a paper substrate of a barrier layer.

37. The paper material of claim 36, wherein the paper material comprises about 80-95 dry weight percent of the fibrous material, and wherein the fibrous material comprises about 75-100 dry weight percent of fibers derived from a plant of the *Nicotiana* species.

38. The paper material of claim 35, wherein the basis weight ranges from about 50 g/m$^2$ to about 275 g/m$^2$ and the caliper ranges from about 3.0 mils to about 200 mils; and wherein the paper material is suitable for use in a at least one of a hard carton suitable to house smoking articles and a container suitable to house smokeless tobacco products.

39. The paper material of claim 38, wherein the paper material comprises about 80-95 dry weight percent of the fibrous material, and wherein the fibrous material comprises about 75-90 dry weight percent of fibers derived from a plant of the *Nicotiana* species.

40. A container, comprising:

a body having a bottom wall and a side wall, the bottom wall and the side wall defining an internal storage compartment adapted for storage of a product;

and a top configured to be engaged with the body, wherein at least one of the bottom wall, side wall, and top comprises the paper material of claim 35;

wherein the paper material has a basis weight ranging from about 10 $g/m^2$ to about 350 $g/m^2$; and wherein the paper material has a caliper ranging from about 1.0 mils to about 200 mils.

41. The container of claim 40, wherein the internal storage compartment contains a plurality of products selected from the group consisting of cigarettes, smokeless tobacco products, and food products.

42. The container of claim 40, wherein the top is removable from the body.

43. The container of claim 40, wherein the top is engaged with the body.

* * * * *